US010679459B2

(12) United States Patent
Ferren et al.

(10) Patent No.: US 10,679,459 B2
(45) Date of Patent: Jun. 9, 2020

(54) VIDEO DISPLAY ASSEMBLY WITH ROTATABLE MECHANICAL BEZEL

(71) Applicant: SG Gaming, Inc., Las Vegas, NV (US)

(72) Inventors: Bran Ferren, Beverly Hills, CA (US); Don Lariviere, Glendale, CA (US); Ivo Janssen, Los Angeles, CA (US); James Hirahara, Alhambra, CA (US); Jeffrey Mulvey, Burbank, CA (US); Michael Ma, Canyon Country, CA (US); Vernon Bernard, Las Vegas, NV (US); Karl Wudtke, Henderson, NV (US); Benjamin E. Isaac, Las Vegas, NV (US); Max Cassidy Whitehead, Las Vegas, NV (US); Eric Lo, Las Vegas, NV (US)

(73) Assignee: SG Gaming, Inc., Las Vegas, NV (US)

( * ) Notice: Subject to any disclaimer, the term of this patent is extended or adjusted under 35 U.S.C. 154(b) by 0 days.

(21) Appl. No.: 16/143,156

(22) Filed: Sep. 26, 2018

(65) Prior Publication Data

US 2019/0102980 A1 Apr. 4, 2019

Related U.S. Application Data

(60) Provisional application No. 62/565,397, filed on Sep. 29, 2017.

(51) Int. Cl.
*G07F 17/32* (2006.01)

(52) U.S. Cl.
CPC ..... *G07F 17/3213* (2013.01); *G07F 17/329* (2013.01)

(58) Field of Classification Search
None
See application file for complete search history.

(56) References Cited

U.S. PATENT DOCUMENTS

| | | | |
|---|---|---|---|
| 4,184,683 | A | 1/1980 | Hooker |
| 4,433,844 | A | 2/1984 | Hooker et al. |
| 5,584,763 | A | 12/1996 | Kelly et al. |
| 5,848,932 | A | 12/1998 | Adams |
| 5,882,261 | A | 3/1999 | Adams |
| 6,089,978 | A | 7/2000 | Adams |
| 6,162,121 | A | 12/2000 | Morro et al. |
| 6,224,483 | B1 | 5/2001 | Mayeroff |
| 6,334,814 | B1 | 1/2002 | Adams |
| 6,561,512 | B2 | 5/2003 | Luciano et al. |
| 6,605,000 | B2 | 8/2003 | Adams |
| 6,663,488 | B1 | 12/2003 | Adams |
| 6,712,694 | B1 | 3/2004 | Nordman |

(Continued)

*Primary Examiner* — Ronald Laneau

(57) ABSTRACT

Disclosed are embodiments of a video display input assembly including a mechanical rotatable bezel surrounding the video display. The video display input assembly is suitable for use in a gaming terminal, a gaming cabinet or a gaming machine, including as a retrofit to an pre-existing gaming machine. Direction and speed of a manual rotation of the bezel is detected and interpreted. The result may be used to control various aspects of operation of the gaming terminal, gaming cabinet or gaming machine, including providing input for game play. The video display may be updated in real-time to reflect the rotation of the bezel. A motor may be coupled to the rotatable bezel to provide resistance, assistance or operator feedback.

25 Claims, 17 Drawing Sheets

(56) References Cited

U.S. PATENT DOCUMENTS 6,827,646 B2 12/2004 Adams
6,942,571 B1 9/2005 McAllister et al.
7,179,169 B2 2/2007 Beaulieu et al.
7,204,754 B2 4/2007 Gray et al.
7,216,867 B1 5/2007 Luciano et al.
7,226,358 B2 6/2007 Miller et al.
7,326,112 B2 2/2008 Nordman
7,425,177 B2 9/2008 Rodgers et al.
7,442,123 B2 10/2008 Brill et al.
7,465,230 B2 12/2008 LeMay et al.
7,473,173 B2 1/2009 Peterson et al.
7,559,837 B1 7/2009 Yoseloff et al.
7,594,848 B2 9/2009 Thomas
7,614,952 B2 11/2009 Elias
7,674,172 B2 3/2010 Miltenberger et al.
7,766,329 B1 8/2010 Kelly et al.
7,823,883 B1 11/2010 Kelly et al.
7,878,506 B1 2/2011 Kelly et al.
7,922,175 B1 4/2011 Kelly et al.
8,142,273 B2 3/2012 Williams et al.
8,337,314 B2 12/2012 Waxman et al.
8,502,936 B2 8/2013 Rasmussen et al.
8,535,141 B2 9/2013 Rommerdahl et al.
8,535,148 B2 9/2013 Vallejo et al.
8,613,656 B2 12/2013 Wudtke et al.
8,622,803 B2 1/2014 Cuddy et al.
8,622,808 B2 1/2014 Pececnik et al.
8,622,825 B2 1/2014 Griswold et al.
8,657,666 B2 2/2014 Wudtke et al.
8,657,676 B2 2/2014 Kelly et al.
8,663,009 B1 3/2014 Pacey et al.
8,715,053 B2 5/2014 Kelly et al.
8,771,051 B2 7/2014 Mattice et al.
8,808,094 B2 8/2014 DeSimone et al.
8,956,215 B2 2/2015 Iverson et al.
8,956,216 B1 2/2015 LeSourd et al.
8,974,280 B2 3/2015 LeSourd
9,218,709 B2 12/2015 Young
9,336,962 B2 5/2016 Wudtke et al.
9,613,485 B2 4/2017 Barragan
9,972,161 B2 5/2018 Bernard et al.
10,062,237 B2 8/2018 Devine et al.
2005/0060051 A1* 3/2005 Mattice ..... G07F 17/32 700/92
2006/0052152 A1* 3/2006 Tedsen ..... G07F 17/3211 463/16
2007/0287530 A1 12/2007 Seelig et al.
2007/0293301 A1 12/2007 Seelig et al.
2009/0131168 A1 5/2009 Waxman et al.
2009/0325683 A1 12/2009 Wudtke et al.
2009/0325684 A1 12/2009 Wudtke et al.
2009/0325695 A1 12/2009 Wudtke et al.
2011/0118014 A1 5/2011 Mitchell et al.
2011/0212774 A1 9/2011 Wudtke et al.
2012/0122545 A1 5/2012 Watkins et al.
2012/0122571 A1 5/2012 DeSimone et al.
2014/0018150 A1 1/2014 Wells et al.
2014/0194182 A1 7/2014 Young
2016/0001178 A1* 1/2016 Munakata ..... G07F 17/323 463/31
2016/0042591 A1 2/2016 Bernard et al.
2016/0175701 A1 6/2016 Froy et al.
2016/0180636 A1 6/2016 David et al.
2017/0053478 A1* 2/2017 Wudtke ..... G07F 17/3213
2017/0345250 A1 11/2017 Pececnik
2018/0012441 A1 1/2018 Pececnik
2018/0108206 A1 4/2018 Pececnik
2018/0151022 A1 5/2018 Bernard et al.

* cited by examiner

VIDEO DISPLAY ASSEMBLY WITH ROTATABLE MECHANICAL BEZEL

RELATED APPLICATIONS

This patent application claims the benefit of priority to U.S. Provisional Patent Application Ser. No. 62/565,397, filed on Sep. 29, 2017, the contents of which are hereby incorporated by reference in their entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming systems, apparatus, and methods and, more particularly, to a video wheel display with a rotatable mechanical bezel device for use in an electronic wagering game machine housing or other related applications.

BACKGROUND OF THE INVENTION

Gaming machines, such as slot machines, video poker machines and the like, have been a cornerstone of the gaming industry for several years. The aesthetics of gaming machines are important for attracting players and improving the overall appearance of machines. Further, there is a continued need for user interfaces that are attractive and intuitive to use. Therefore, there is a continuing need for improving gaming machines to be visually and functionally appealing.

SUMMARY OF THE INVENTION

According to one or more aspects of the present invention, a gaming terminal, gaming cabinet or gaming machine primarily dedicated to playing a casino wagering game includes a housing configured to house gaming components and a display comprising a video display and a rotatable mechanical bezel surrounding the display to provide both output and input capabilities. The display assembly provides an ornamental feature as well.

Additional aspects of the invention will be apparent to those of ordinary skill in the art in view of the detailed description of various embodiments, which is made with reference to the drawings, a brief description of which is provided below.

DETAILED DESCRIPTION

Figure 1:
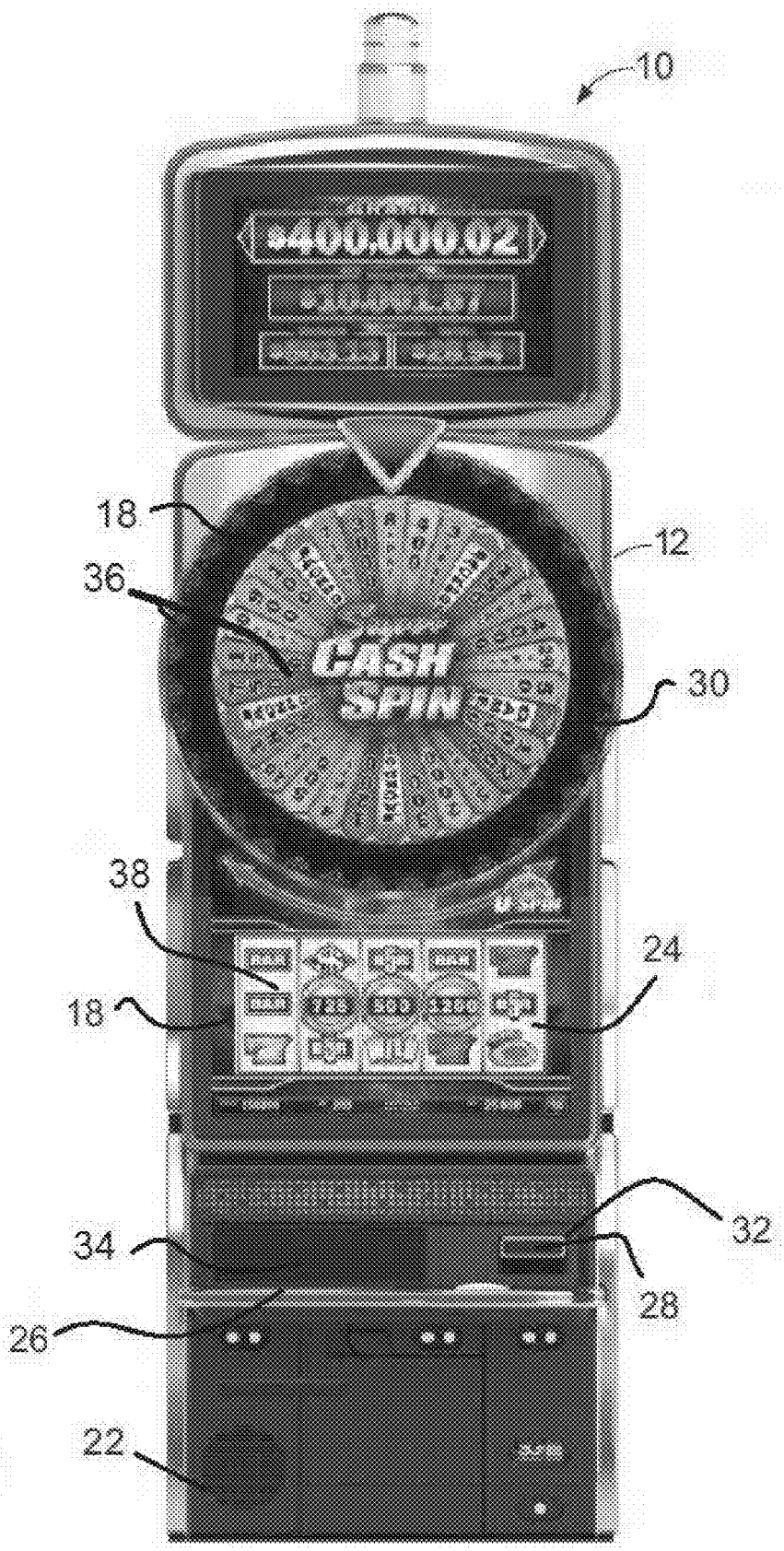
FIG. 1 is an isometric view of a free-standing gaming machine in accordance with one or more embodiments.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering game," "casino wagering game," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game involves wagers of real money, as found with typical land-based or online casino games. In other embodiments, the wagering game additionally, or alternatively, involves wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

In accordance with one or more embodiments, a video display assembly for a gaming machine includes a controller, a video display coupled to the controller, the video display comprising a first region and a second region, the first region depicting a segmented rotatable wheel, the second region visually separated by one or more physical aspects of the video display assembly and depicting one or more game play indicia, an encoder coupled to the controller and a mechanical annular rotatable bezel coupled to the encoder and overlaying the video display such that the bezel encompasses at least a portion of the first region, the portion being visible within the periphery of the bezel. The controller executes logic to determine speed and direction of the bezel in response to signals generated by the encoder according to an initial manual player input to the bezel and directs rotation of the segmented rotatable wheel on the video display in accordance with the determined speed and direction.

In accordance with one or more embodiments, the video display may include a motor operatively coupled to the rotatable bezel. In some embodiments, this motor may be a direct current motor and may be coupled to the bezel via one or more gears.

In some embodiments, the controller detects cessation of the initial manual player input and provides mechanical assistance via the motor to prolong the spin of the bezel and of the wheel for a time period associated with the magnitude of the initial manual player input. The controller may adjusts the speed of the motor to match the rotational speed of the bezel to the rotational speed of the segmented rotatable wheel or, alternately, decouple the rotational speed of the bezel in response to, for example, a tilt condition. In some embodiments, the controller detects a tilt condition if the rotation of the bezel is externally slowed subsequent to the end of the initial manual player input.

In accordance with one or more embodiments, the motor provides resistance to the rotation of the rotatable bezel. In some embodiments, the resistance to the rotation of the bezel includes matching the rotational speeds of the bezel and the segmented rotatable wheel according to a predetermined deceleration profile until the segmented rotatable wheel slows to a stop at a predetermined location. In some embodiments, the motor can be locked to prevent rotation of the bezel.

The video display assembly is associated with a wagering game playable on the gaming machine. In some embodiments, the other game play indicia are associated with a base game, and the controller is configured to unlock the motor or otherwise enable the bezel to be rotated in response to a triggering condition in the base game so the video wheel may be used in play of a secondary or bonus game. In other embodiments, the video wheel may be used in play of some or all of the base game.

Referring to FIG. 1, there is shown a free-standing gaming machine 10 similar to those operated in gaming establishments, such as casinos. With regard to the present invention, the gaming machine 10 may be any type of gaming terminal or machine and may have varying structures and methods of operation. For example, in some aspects, the gaming machine 1 0 is an electromechanical gaming terminal configured to play mechanical slots, whereas in other aspects, the gaming machine is an electronic gaming terminal configured to play a video casino game, such as slots, keno, poker, blackjack, roulette, craps, etc. The gaming machine 10 may or may not be primarily dedicated for use in playing wagering games. An exemplary type of gaming machine is disclosed in U.S. Pat. No. 6,517,433, which is incorporated herein by reference in its entirety.

The gaming machine 10 illustrated in FIG. 1 comprises a gaming cabinet 12 that securely houses various input devices, output devices, input/output devices, internal electronic/electromechanical components, and wiring. The cabinet 12 includes exterior walls, interior walls and shelves for mounting the internal components and managing the wiring, and one or more front doors that are locked and require a physical or electronic key to gain access to the interior compartment of the cabinet 12 behind the locked door.

The input devices, output devices, and input/output devices are disposed on, and securely coupled to, the cabinet 12. By way of example, the output devices include a primary display 18, and one or more audio speakers 22. The primary display 18 may be a mechanical-reel display device, a video display device, or a combination thereof in which a transmissive video display is disposed in front of the mechanical-reel display to portray a video image superimposed upon the mechanical-reel display. The displays variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming machine 10. The gaming machine 10 includes a touch screen(s) 24 mounted over the primary display, a video display assembly 26, which may comprise physical button switches (not shown) or another overlaying touchscreen. The video display may also include a mechanical rotatable bezel 30, which serves as an input device. The gaming machine 10 also may include a bill/ticket acceptor 28, a player tracking system panel 34 which may include a card reader/writer, a ticket dispenser 32 (which may be interface with the same input/output slot as bill/ticket acceptor 28, and player-accessible ports (e.g., audio output jack for headphones, video headset jack, USB port, wireless transmitter/receiver, etc.), not shown. It should be understood that numerous other peripheral devices and other elements exist and are readily utilizable in any number of combinations to create various forms of a gaming machine in accord with the present concepts.

The player input devices, such as the touch screen 24, button panel 26, rotatable bezel 30, a mouse, a joystick, a gesture-sensing device, a voice-recognition device, and a virtual-input device, accept player inputs and transform the player inputs to electronic data signals indicative of the player inputs, which correspond to an enabled feature for such inputs at a time of activation (e.g., pressing a "Max Bet" button or soft key to indicate a player's desire to place a maximum wager to play the wagering game). The inputs, once transformed into electronic data signals, are output to game-logic circuitry for processing. The electronic data signals are selected from a group consisting essentially of an electrical current, an electrical voltage, an electrical charge, an optical signal, an optical element, a magnetic signal, and a magnetic element.

The gaming machine 10 includes one or more value input/payment devices and value output/payout devices. The value input devices are used to deposit cash or credits onto the gaming machine 10. The cash or credits are used to fund wagers placed on the wagering game played via the gaming machine 10. Examples of value input devices include, but are not limited to, a coin acceptor, the bill/ticket acceptor 28, the card reader/writer 30, a wireless communication interface for reading cash or credit data from a nearby mobile device, and a network interface for withdrawing cash or credits from a remote account via an electronic funds transfer. The value output devices are used to dispense cash or credits from the gaming machine 10. The credits may be exchanged for cash at, for example, a cashier or redemption station. Examples of value output devices include, but are not limited to, a coin hopper for dispensing coins or tokens, a bill dispenser, the card reader/writer, the ticket dispenser 32 for printing tickets redeemable for cash or credits, a wireless communication interface for transmitting cash or credit data to a nearby mobile device, and a network interface for depositing cash or credits to a remote account via an electronic funds transfer.

Figure 2:
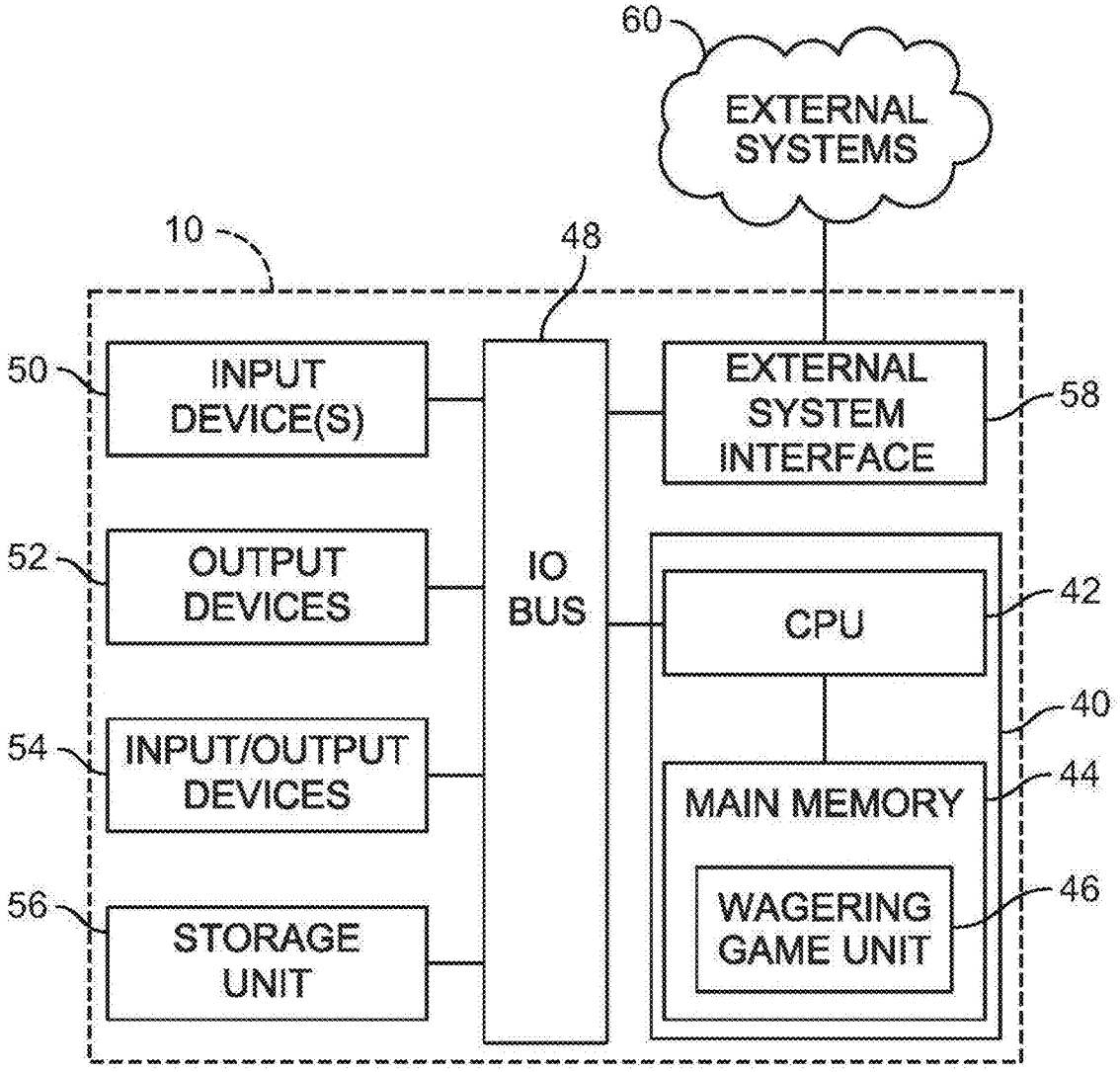
FIG. 2 is a schematic view of a gaming system including the gaming machine.

Turning now to FIG. 2, there is shown a block diagram of the gaming-machine architecture. The gaming machine 10 includes game-logic circuitry 40 securely housed within a locked box inside the gaming cabinet 12 (see FIG. 1). The game-logic circuitry 40 includes a central processing unit (CPU) 42 connected to a main memory 44 that comprises one or more memory devices. The CPU 42 includes any suitable processor(s), such as those made by Intel and AMD. By way of example, the CPU 42 includes a plurality of microprocessors including a master processor, a slave processor, and a secondary or parallel processor. Game-logic circuitry 40, as used herein, comprises any combination of hardware, software, or firmware disposed in or outside of the gaming machine 10 that is configured to communicate with or control the transfer of data between the gaming machine 10 and a bus, another computer, processor, device, service, or network. The game-logic circuitry 40, and more specifically the CPU 42, comprises one or more controllers or processors and such one or more controllers or processors need not be disposed proximal to one another and may be located in different devices or in different locations. The game-logic circuitry 40, and more specifically the main memory 44, comprises one or more memory devices which need not be disposed proximal to one another and may be located in different devices or in different locations. The game-logic circuitry 40 is operable to execute all of the various gaming methods and other processes disclosed herein. The main memory 44 includes a wagering-game unit 46. In one embodiment, the wagering-game unit 46 causes wagering games to be presented, such as video poker, video black jack, video slots, video lottery, etc., in whole or part.

The game-logic circuitry 40 is also connected to an input/output (I/O) bus 48, which can include any suitable bus technologies, such as an AGTL+ frontside bus and a PCI backside bus. The I/O bus 48 is connected to various input devices 50, output devices 52, and input/output devices 54 such as those discussed above in connection with FIG. 1. The I/O bus 48 is also connected to a storage unit 56 and an external-system interface 58, which is connected to external system(s) 60 (e.g., wagering-game networks).

The external system 60 includes, in various aspects, a gaming network, other gaming machines or terminals, a gaming server, a remote controller, communications hardware, or a variety of other interfaced systems or components, in any combination. In yet other aspects, the external system 60 comprises a player's portable electronic device (e.g., cellular phone, electronic wallet, etc.) and the external-system interface 58 is configured to facilitate wireless communication and data transfer between the portable electronic device and the gaming machine 10, such as by a near-field communication path operating via magnetic-field induction or a frequency-hopping spread spectrum RF signals (e.g., Bluetooth, etc.).

The gaming machine 10 optionally communicates with the external system 60 such that the gaming machine 10 operates as a thin, thick, or intermediate client. The game-logic circuitry 40—whether located within ("thick client"), external to ("thin client"), or distributed both within and external to ("intermediate client") the gaming machine 10—is utilized to provide a wagering game on the gaming machine 10. In general, the main memory 44 stores programming for a random number generator (RNG), game-outcome logic, and game assets (e.g., art, sound, etc.)—all of which obtained regulatory approval from a gaming control board or commission and are verified by a trusted authentication program in the main memory 44 prior to game execution. The authentication program generates a live authentication code (e.g., digital signature or hash) from the memory contents and compares it to a trusted code stored in the main memory 44. If the codes match, authentication is deemed a success and the game is permitted to execute. If, however, the codes do not match, authentication is deemed a failure that must be corrected prior to game execution. Without this predictable and repeatable authentication, the gaming machine 10, external system 60, or both are not allowed to perform or execute the RNG programming or game-outcome logic in a regulatory-approved manner and are therefore unacceptable for commercial use.

When a wagering-game instance is executed, the CPU 42 (comprising one or more processors or controllers) executes the RNG programming to generate one or more pseudo-random numbers. The pseudo-random numbers are divided into different ranges, and each range is associated with a respective game outcome. Accordingly, the pseudo-random numbers are utilized by the CPU 42 when executing the game-outcome logic to determine a resultant outcome for that instance of the wagering game. The resultant outcome is then presented to a player of the gaming machine 10 by accessing the associated game assets, required for the resultant outcome, from the main memory 44. The CPU 42 causes the game assets to be presented to the player as outputs from the gaming machine 10 (e.g., audio and video presentations). Instead of a pseudo-RNG, the game outcome may be derived from random numbers generated by a physical RNG that measures some physical phenomenon that is expected to be random and then compensates for possible biases in the measurement process. Whether the RNG is a pseudo-RNG or physical RNG, the RNG uses a seeding process that relies upon an unpredictable factor (e.g., human interaction of turning a key) and cycles continuously in the background between games and during game play at a speed that cannot be timed by the player, for example, at a minimum of 100 Hz (100 calls per second) as set forth in Nevada's New Gaming Device Submission Package. Accordingly, the RNG cannot be carried out manually by a human.

The gaming machine 10 may be used to play central determination games, such as electronic pull-tab and bingo games. In an electronic pull-tab game, the RNG is used to randomize the distribution of outcomes in a pool and/or to select which outcome is drawn from the pool of outcomes when the player requests to play the game. In an electronic bingo game, the RNG is used to randomly draw numbers that players match against numbers printed on their electronic bingo card.

The gaming machine 10 may include additional peripheral devices or more than one of each component shown in FIG. 2. Any component of the gaming-machine architecture includes hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic-disk storage media, optical storage media, flash memory, etc.

Figure 3:
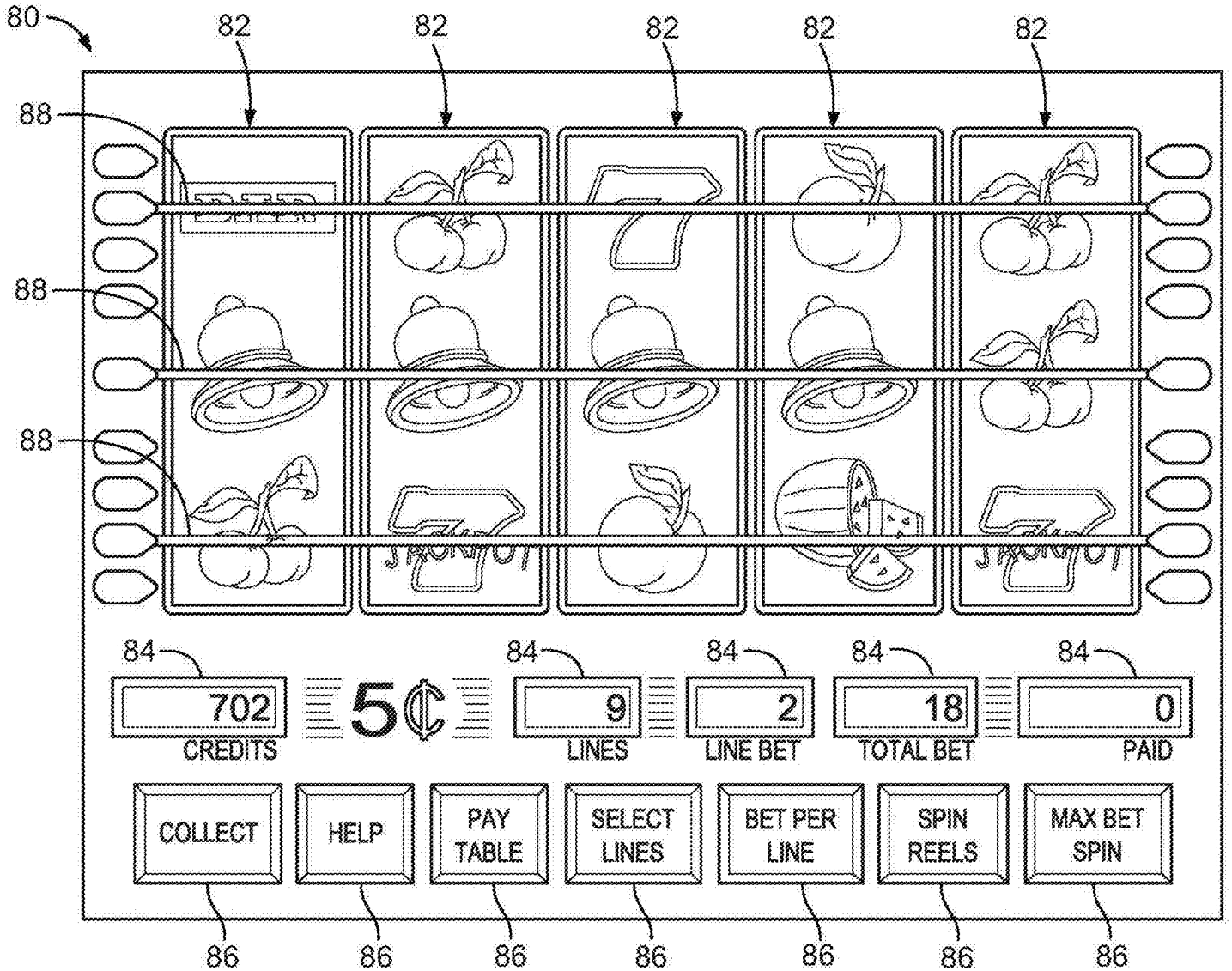
FIG. 3 is an image of an exemplary basic-game screen of a wagering game displayed on the gaming machine.

Referring now to FIG. 3, there is illustrated an image of a basic-game screen 80 adapted to be displayed on the primary display 18. The basic-game screen 80 portrays a plurality of simulated symbol-bearing reels 82. Alternatively or additionally, the basic-game screen 80 portrays a plurality of mechanical reels or other video or mechanical presentation consistent with the game format and theme. The basic-game screen 80 also advantageously displays one or more game-session credit meters 84 and various touch screen buttons 86 adapted to be actuated by a player. A player can operate or interact with the wagering game using these touch screen buttons or other input devices such as the buttons 26 shown in FIG. 1. The game-logic circuitry 40 operates to execute a wagering-game program causing the primary display 18 to display the wagering game.

In response to receiving an input indicative of a wager, the reels 82 are rotated and stopped to place symbols on the reels in visual association with paylines such as paylines 88. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering-game outcome is provided or displayed in response to the wager being received or detected. The wagering-game outcome, for that particular wagering-game instance, is then revealed to the player in due course following initiation of the wagering game. The method comprises the acts of conducting the wagering game using a gaming apparatus, such as the gaming machine 10 depicted in FIG. 1, following receipt of an input from the player to initiate a wagering-game instance. The gaming machine 10 then communicates the wagering-game outcome to the player via one or more output devices (e.g., primary display 18) through the display of information such as, but not limited to, text, graphics, static images, moving images, etc., or any combination thereof. In accord with the method of conducting the wagering game, the game-logic circuitry 40 transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the game-logic circuitry 40 is configured to process the electronic data signal, to interpret the data signal (e.g., data signals corresponding to a wager input), and to cause further actions associated with the interpretation of the signal in accord with stored instructions relating to such further actions executed by the controller. As one example, the CPU 42 causes the recording of a digital representation of the wager in one or more storage media (e.g., storage unit 56), the CPU 42, in accord with associated stored instructions, causes the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM, etc.). The noted second state of the data storage media comprises storage in the storage media of data representing the electronic data signal from the CPU 42 (e.g., the wager in the present example). As another example, the CPU 42 further, in accord with the execution of the stored instructions relating to the wagering game, causes the primary display 18, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of the stored instructions relating to the wagering game is further conducted in accord with a random outcome (e.g., determined by the RNG) that is used by the game-logic circuitry 40 to determine the outcome of the wagering-game instance. In at least some aspects, the game-logic circuitry 40 is configured to determine an outcome of the wagering-game instance at least partially in response to the random parameter.

In one embodiment, the gaming machine 10 and, additionally or alternatively, the external system 60 (e.g., a gaming server), means gaming equipment that meets the hardware and software requirements for fairness, security, and predictability as established by at least one state's gaming control board or commission. Prior to commercial deployment, the gaming machine 10, the external system 60, or both and the casino wagering game played thereon may need to satisfy minimum technical standards and require regulatory approval from a gaming control board or commission (e.g., the Nevada Gaming Commission, Alderney Gambling Control Commission, National Indian Gaming Commission, etc.) charged with regulating casino and other types of gaming in a defined geographical area, such as a state. By way of non-limiting example, a gaming machine in Nevada means a device as set forth in NRS 463.0155, 463.0191, and all other relevant provisions of the Nevada Gaming Control Act, and the gaming machine cannot be deployed for play in Nevada unless it meets the minimum standards set forth in, for example, Technical Standards 1 and 2 and Regulations 5 and 14 issued pursuant to the Nevada Gaming Control Act. Additionally, the gaming machine and the casino wagering game must be approved by the commission pursuant to various provisions in Regulation 14. Comparable statutes, regulations, and technical standards exist in other gaming jurisdictions. As can be seen from the description herein, the gaming machine 10 may be implemented with hardware and software architectures, circuitry, and other special features that differentiate it from general-purpose computers (e.g., desktop PCs, laptops, and tablets).

Figure 4A:
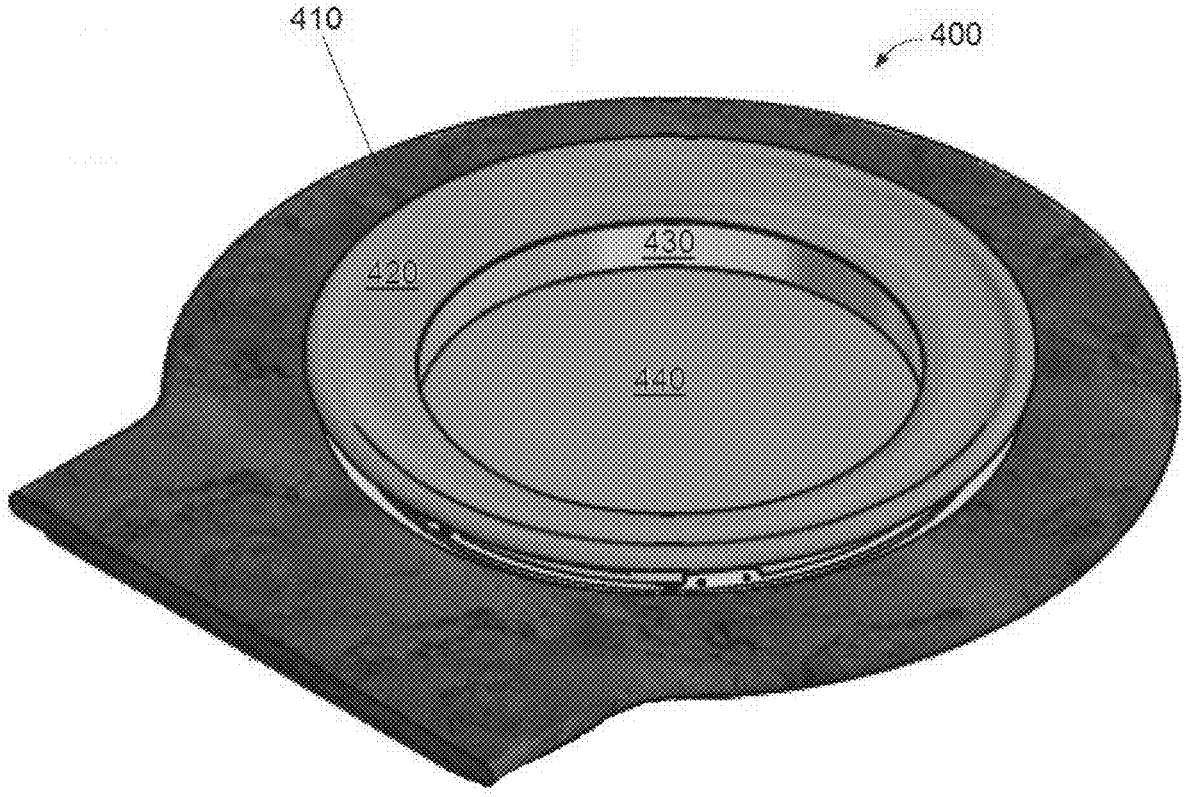
FIG. 4A is an illustration of an exemplar video display assembly in accordance with one or more embodiments.

Referring now to FIG. 4A, in accordance with one or more embodiments, the video display assembly 26 of FIG. 1 is shown in more detail. In FIG. 4, the video display input assembly 400 includes an annular outer surround 410 which may serve as a player hand rest. The outer surround 410 may be constructed of a material such as Corian™, granite, plastic, or any similar and suitable material. The video display input assembly 400 further includes an annular mechanical rotatable bezel assembly which includes a player-manipulated ring 420 connected to a ring mount 430 and other internal components which will be further described below. Video display input assembly 400 further includes a video display 440, typically an LED, LCD or OLED display, though any suitable display technology may be used. Video display 440 may also incorporate a touch screen. For example, video display 440 may be a display commonly used in computer monitors or tablets such as a Microsoft Surface Pro™ or Apple iPad™. The annular rotatable mechanical bezel encompasses at least a first portion of the video display 440, the portion being visible within the periphery of the bezel. In some embodiments, video display 440 may also extend beyond the boundaries of the outer surround 410 such that at least a second portion of the video display 440 is visible and usable for other purposes such as paytables, additional areas of game play, etc.

Figure 4B:
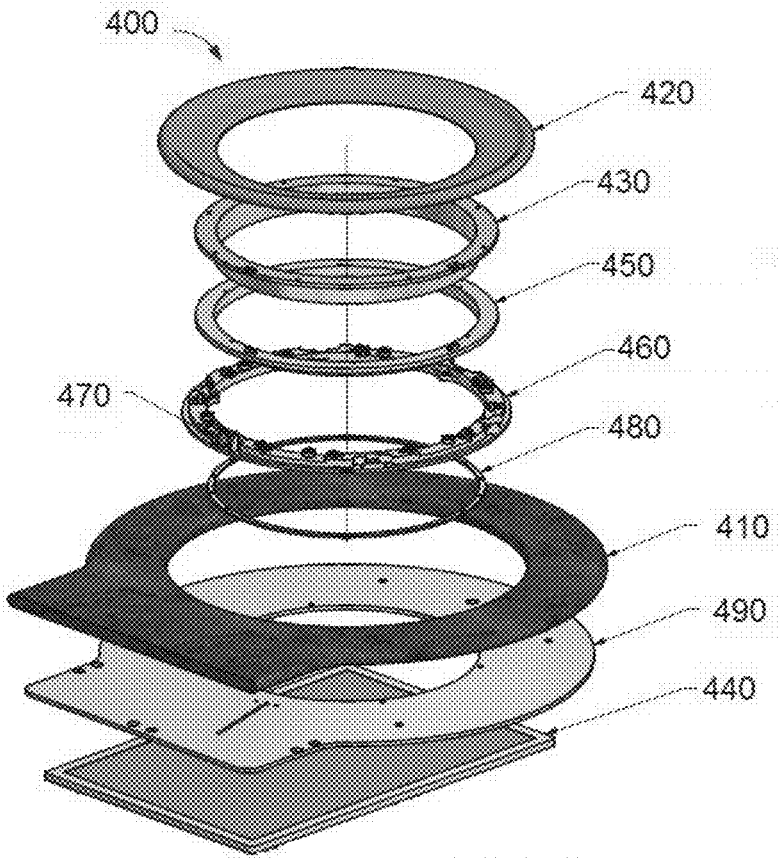
FIG. 4B is an exploded view of elements of the video display assembly of FIG. 4A.

Continuing with FIG. 4B, in accordance with one or more embodiments, an exploded illustration provides additional detail of the components described in FIG. 4A. Retaining ring 480 serves to connect an annular bearing assembly 460 on which floats a bearing race 480 to ring mount 430. This sub-assembly allows player-manipulated ring 420 to rotate freely. An encoder 470 is mounted in contact with the bearing race 480 to track the speed and direction of the bearing race's, and, thus, the player-manipulated ring's rotation. The outer surround 410 may be mounted on a support plate 490, which may be constructed of metal, plastic or any other suitable material. The outer surround 410 and its support plate 490 also serve to mask portions of the typically rectangular display from view so the visible display area is circular. In accordance with one or more embodiments, especially those which may include one or more wheel pointers, the display may be mounted at a 45-degree angle to produce the largest possible circular viewing area beneath the mask while providing display real estate outside of the wheel image for a pointer also presented on the display. An example of such an approach may be found disclosed in co-owned U.S. patent application Ser. No. 14/493,472, entitled "Gaming Machine Top Display," incorporated by reference in its entirety. While the example of a circular viewing area is primarily used herein, it should be understood that the shape of the mask provided by the outer surround 410 and support plate 490 may vary. For example, a rectangular, diamond, hexagonal, octagonal or any other shaped viewing area may be provided within the annular area provided by the bezel assembly. Similarly, in accordance with other embodiments, the player-manipulated ring 420 coupled to ring mount 430 may take other forms such as handle bars, a ship's wheel with spokes, a square, an oval, or any other suitable shape.

Figure 5:
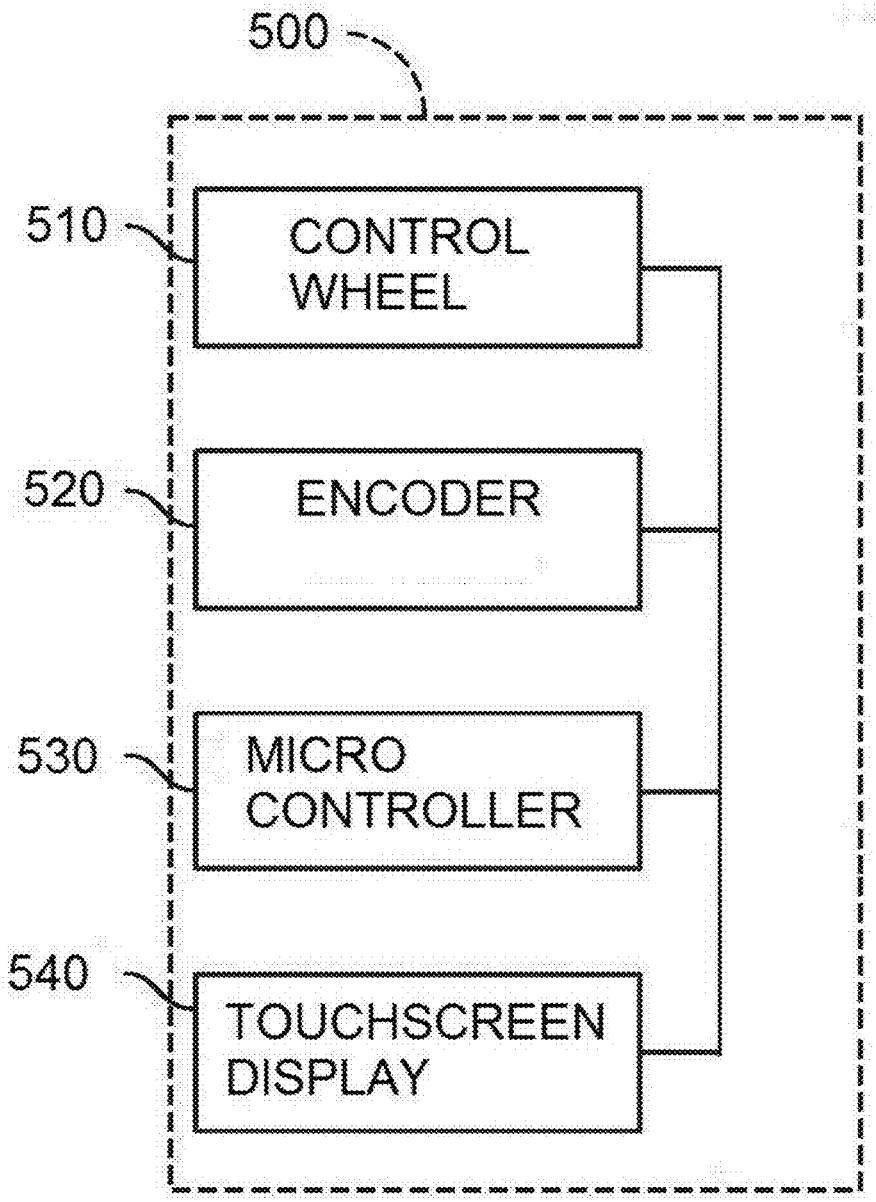
FIG. 5 is a schematic view of the components of a video display assembly in accordance with one or more embodiments.
Figure 13:
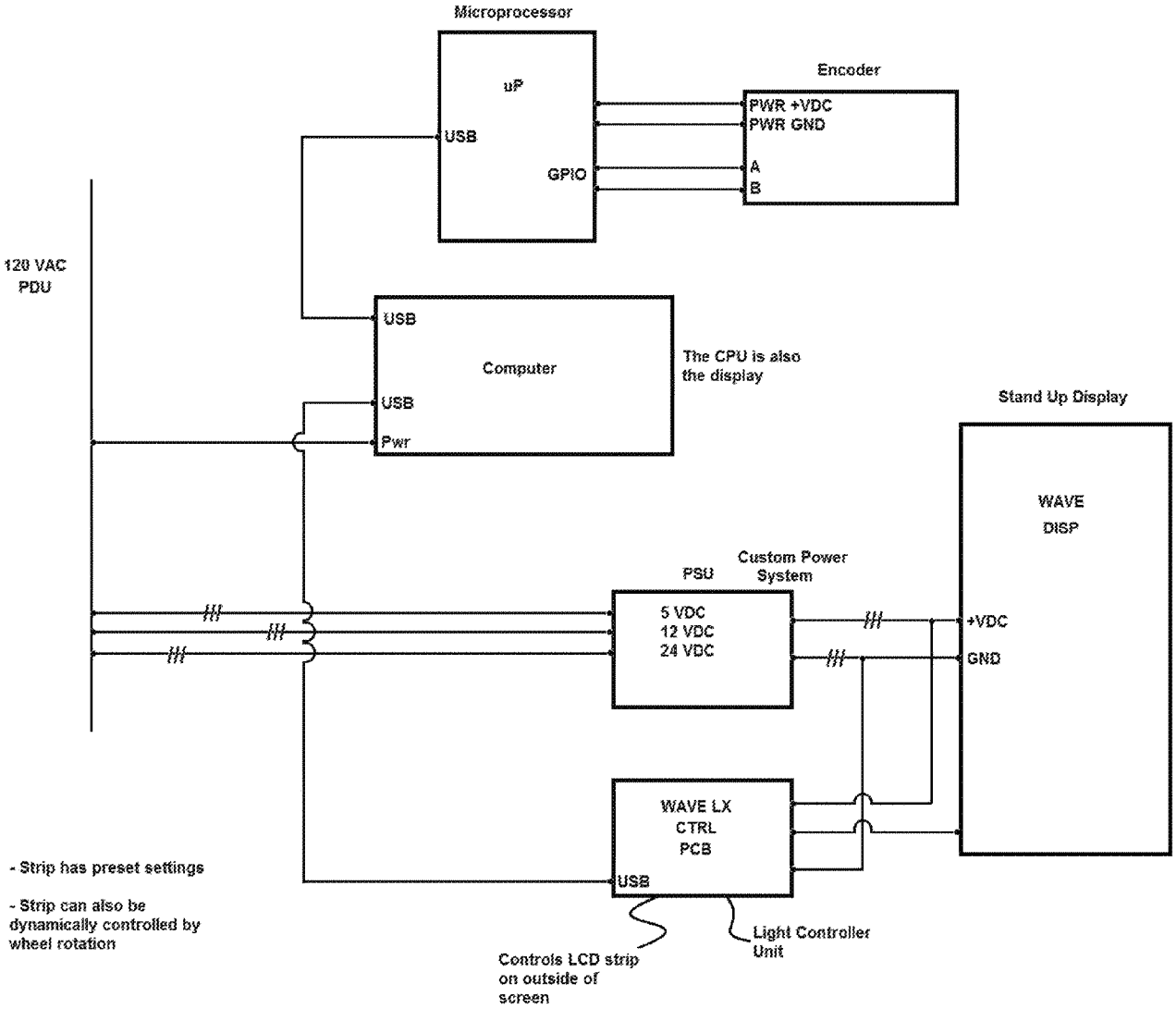
FIG. 13 is another schematic view of the system components of a video display assembly in accordance with one or more embodiments.

In accordance with one or more embodiments, FIG. 5 illustrates an exemplary system diagram for a video display assembly 500. An annular mechanical rotatable bezel assembly 510, as described in FIGS. 4A and 4B is coupled to encoder 520. When the mechanical rotatable bezel assembly 510 is rotated, signals generated by encoder 520 are processed by microcontroller 530 to determine the speed and direction of the rotation. A presentation of a wheel or any other image controllable by the mechanical rotatable bezel assembly and displayed in video display 540, which corresponds to video display 440 of FIGS. 4A and 4B, is adjusted according to the determined speed and direction of the rotation. FIG. 13 also illustrates a system diagram of a video display input assembly of the present invention in accordance with one or more embodiments.

Figure 6:
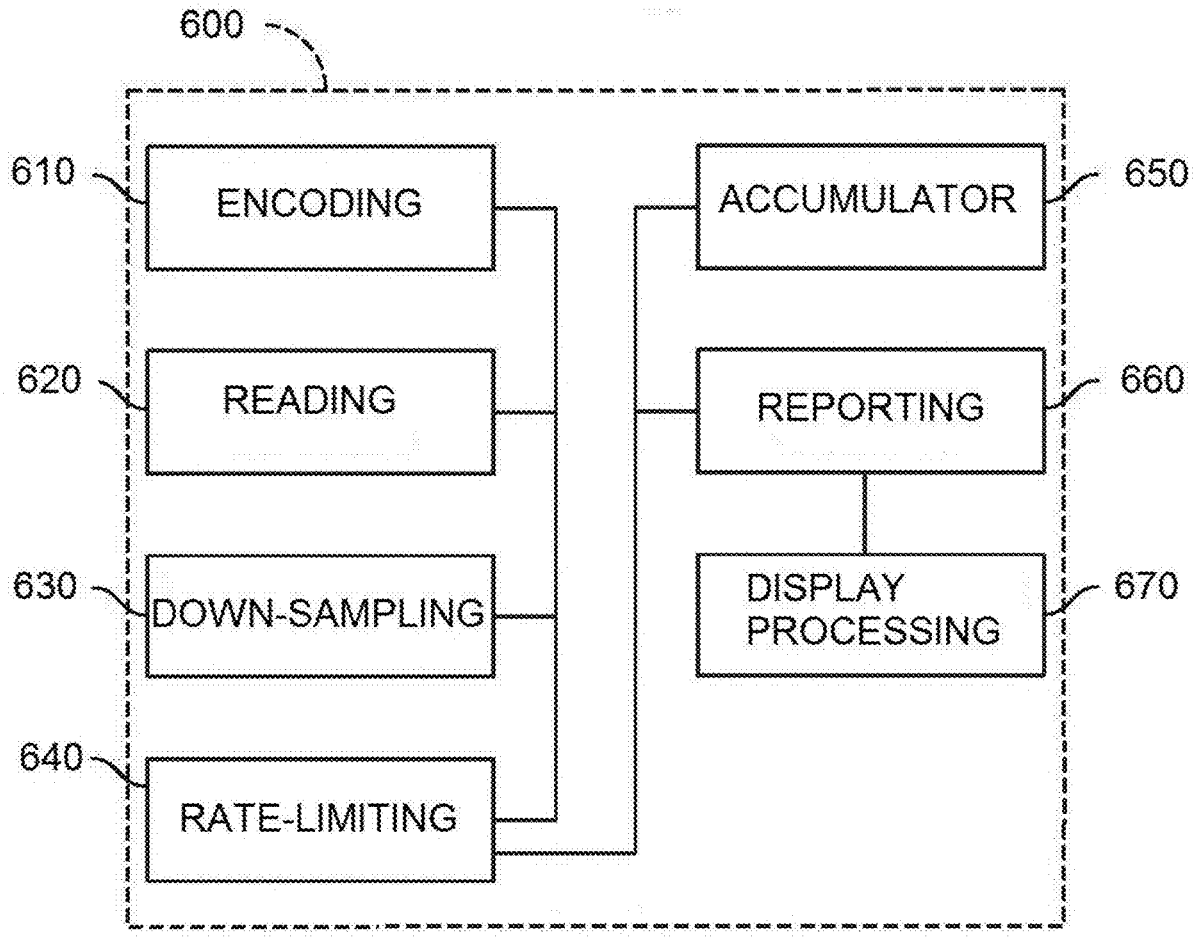
FIG. 6 is a schematic view of a software architecture for a video display assembly in accordance with one or more embodiments.

In accordance with one or more embodiments, FIG. 6 illustrates a software architecture 600 associated with a video input display assembly with a mechanical rotatable bezel as described above. This software may be executed, for example, by microcontroller 530 of FIG. 5 or CPU 42 or by any other processor associated with a video display assembly of this type. Referring to FIG. 6, the encoder (see FIG. 5, 520) converts the rotor rotation caused by movement of the bezel 510 into two channels of electrical pulses receivable by encoding unit or module 610, each channel communicating a high or a low signal. The high or low condition of each signal at a given time is combined into a pulse and such pulses may be used to determine the direction of rotation. The encoder is designed to produce a certain number of pulses, for example, 256 pulses, per full rotor rotation. Reading unit 620 queries the encoding unit 610 for pulses and interprets the pulses to create clockwise or counterclockwise direction information which it outputs to the down-sampling unit 630.

The down-sampling unit 630 receives the pulses from the reading unit 620 and accumulates them until a threshold number of pulses, for example, ten, in the same direction have been received. If the threshold has not been received, a threshold counter is incremented, otherwise, if the threshold has been reached, the down-sampling unit 630 outputs a single directionally encoded pulse to the rate-limiting unit 640 and clears the threshold counter. The adjustable ratio of pulses received to pulses sent provides the ability to tune the system responsiveness for the best user "feel." The rate-limiting unit 640 receives a pulse from the down-sampling unit 630. If this is the first pulse received by the rate-limiting unit 640, it outputs a corresponding initial pulse to the reporting unit 660 and starts a timer. If this is not the first pulse received by the rate-limiting unit, the rate-limiting unit will not send another pulse unless the timer has reached a threshold, for example, 16.667 milliseconds. Instead, the pulse is sent to the accumulator 650, which stores an indication of the pulse and its direction, When the timer reaches or exceeds its threshold, the next pulse received from the down-sampling unit will again sent to the reporting unit 660 and the timer reset. It should be noted that pulses received by the rate-limiting unit 640 are always every nth pulse, where, in this example, n is 10. Thus, pulses in the accumulator 650 and/or sent to the reporting unit are actually "$n^{th}$ pulse" pulses.

The reporting unit 660 reports directional pulses to the display processor 670. When a current pulse is received from the rate-limiting unit 640, the reporting unit queries the accumulator for any other stored pulses. Any stored pulses are output to the display processor 670. The current pulse is also output to the display processor 670. Once queried, the accumulator clears its storage and waits for new pulses from the rate-limiting unit 640. Display processor 670 rotates its displayed video image to reflect the movement of the bezel 510 (FIG. 5) or otherwise responds in proportion to the movement of the bezel.

When the system is first configured, the display processor 670 may be placed in a calibration mode. The bezel 510 is rotated a certain number of degrees and the number of pulses received during this movement is observed. The number of radians per pulse is then computed and stored for use by the display processor 670 when receiving further pulses the rate-limiting unit 640 and the accumulator 650.

As indicated in the above example, the encoder 520 may be a 256 PPR (pulses per revolution) quadrature encoder. From this, it follows that angles as small as Pi/128 can be acted upon. While it is generally desirable to have the highest accuracy as possible when mapping a direct engagement user interface control (such as a large wheel), there are two factors that make that resolution undesirable: ratio and speed. Ratio refers to the mechanical linkage between the encoder and the mechanical rotatable bezel spun by the user. Since the encoder is relatively small (~12 mm diameter) compared to the wheel (for example, ~460 mm diameter), every revolution of the large wheel will spin the encoder ~38 full revolutions, or the equivalent of ~9800 pulses. The other factor is how fast a user might typically spin the wheel. For a game, it may spin as fast as 3 Hz for short periods of time, requiring processing of ~9800*3=~29400 signals a second, an amount of data unnecessary for the desired effect. It is possible to down-sample the pulses by a factor, for example, 10, and report every 10th pulse from the encoder to higher levels of the software application. This effectively reduces resolution by 10, but still ensures that movements as small as 1440 mm/980, or 1.5 mm, can be detected. In TABLE 1, an example of code executed by microcontroller 530, this down-sampling is handled by the THRESHOLD constant during execution of the read_encoder( ) function:

TABLE 1

```
#define THRESHOLD 10
void read_encoder(Encoder enc) {
    static int8_t enc_states[ ] = {0 , −1 , 1 , 0 , 1, 0 , 0 , −1 , −1 , 0 ,
0 , 1 , 0 , 1 , −1 , 0};
    // Combine both pin inputs into a single 2-bit number
    int8_t temp_state = (digitalRead(enc.pinl) << 1) +
    digitalRead(enc.pin2);
    if (temp_state != last_positions[enc.pinl]) {
        // Bit shift 2 spaces to get a 4-bit int with the right-most bits
        set to 0
        int8_t mixed_state = last_positions[enc . pinl] << 2;
        // Set the last 2 bits to the current state
        mixedstate |= temp_state;
        // Update the minor state
        states[enc.pinl] += enc_states[mixed_state];
        // Only report past a threshold
```

TABLE 1-continued

```
        if (abs(states[enc.pinl]) >THRESHOLD) {
            report(states[enc . pinl] > 0 ? 1 : −1 , enc.pin!, enc .id,
            "e");
        }
        last_positions[enc.pinl] = temp_state;
    }
}
```

In TABLE 1, on line 15, the report function is only called if the THRESHOLD is exceeded, after which the current state (states[enc.pin1]) is reset back to 0 inside the report function, effectively ignoring all but every 10th pulse.

While down-sampling works fairly well by itself, it can break down at higher speeds. In the above example of ~2940 signals per second, the frame rate of the application can be exceeded. To combat this effect, down-sampling is combined with rate-limiting, which prevents the send rate from exceeding a predetermined limit, for example, 60 Hz or 16.66 ms per send event. An example of an implementation of this down-sampling may be seen in the report( ) function of TABLE 2:

TABLE 2

```
#define MIN_DELAY 16667
void report(int8_t state, uint8_t cache_id, String id, String prefix) {
    if (state != states[cache_id]) {
        states[cache_id] = state;
        cumulative_state +− state;
    }
    time_since_last_report ..... micros( ) − last_report;
    last_report = micros( );
        if (time_since_last_report > MIN_DELAY) {
        Serial.println(prefix + "|" + id+ "|" + cumulative_state);
        cumulative_state = 0;
        time_since_last_report = 0;
        }
    }
}
```

With the application receiving ~980 pulses per second, at a maximum rate of 60 Hz, the pulse can be correlated to on-screen movement. As mentioned above, to make the movement match the physical rotation as closely as possible, the bezel assembly may be calibrated in advance. The bezel may be rotated 180 degrees and the number of pulses counted. In the example code of TABLE 3, an ANGLE_PER_HW_TICK constant based on 1110 pulses has been hard-coded, though, in a more flexible implementation, this determined configuration value may also be stored in system memory and accessed therefrom by the code:

TABLE 3

```
const ANGLE_PER...HW_TICK = Math.PI/ 1110
function hardwareHandler(diff) {
    if (this.menu I I this.playing I I this.dragCurrentPoint) return
    let time = performance.now( )
    this.reels.forEach((reel, i) => {
        reel.y = ((reel.y + diff * ANGLE_PER...HW_TICK) + (2 * Math.PI))% (2
* Math.PI)
    })
    // Track current time and position
    if (this._lastHardwareTime) {
        this._hardwareTracker.push([time − this._lastHardwareTime,
this.reels[0].y])
        this._hardwareTracker = this._hardwareTracker.slice(−10)
    // Calculate last velocity
    if (this._hardwareTracker.length > 5) {
        let avgVel = this._hardwareTracker.reduce((acc, val, index) => {
            if (index == 0) return acc
                return acc + (mod(val[l] − this._hardwareTracker[index − 1][1] + Math.PI,
```

TABLE 3-continued

```
2*Math.PI) – Math.PI)
                }, 0) / this._hardwareTracker.reduce((acc, val)=> ace ..... val[0], 0)
                if (Math.abs(avgVel) > .0025) {
                    this.play(Math.max(–. 005, Math.min(avgVel * 1.5, .005)))
                }
            }
            this._lastHardwareTime = time
            // Trigger ticks as the player moves the wheel back and forth
        let ticks = Math.floor(this.reels[0].y I ANGLE_PER...SYMBOL)
        if (this._lastTicks && ticks != this._lastTicks) {
        // Pitches increase or decrease to reflect direction of drag
                audioPlayer.tick(this._lastlicks > ticks ? 1 : –1)
            }
            this._lastTicks = ticks
        }
```

The angular rotation of the object (reel.y) is incremented by the number of pulses (diff) multiplied by the angle per pulse (ANGLE_PER_HW_TICK) to produce a smooth video rotation in response to user interaction with the bezel.

Figure 7:
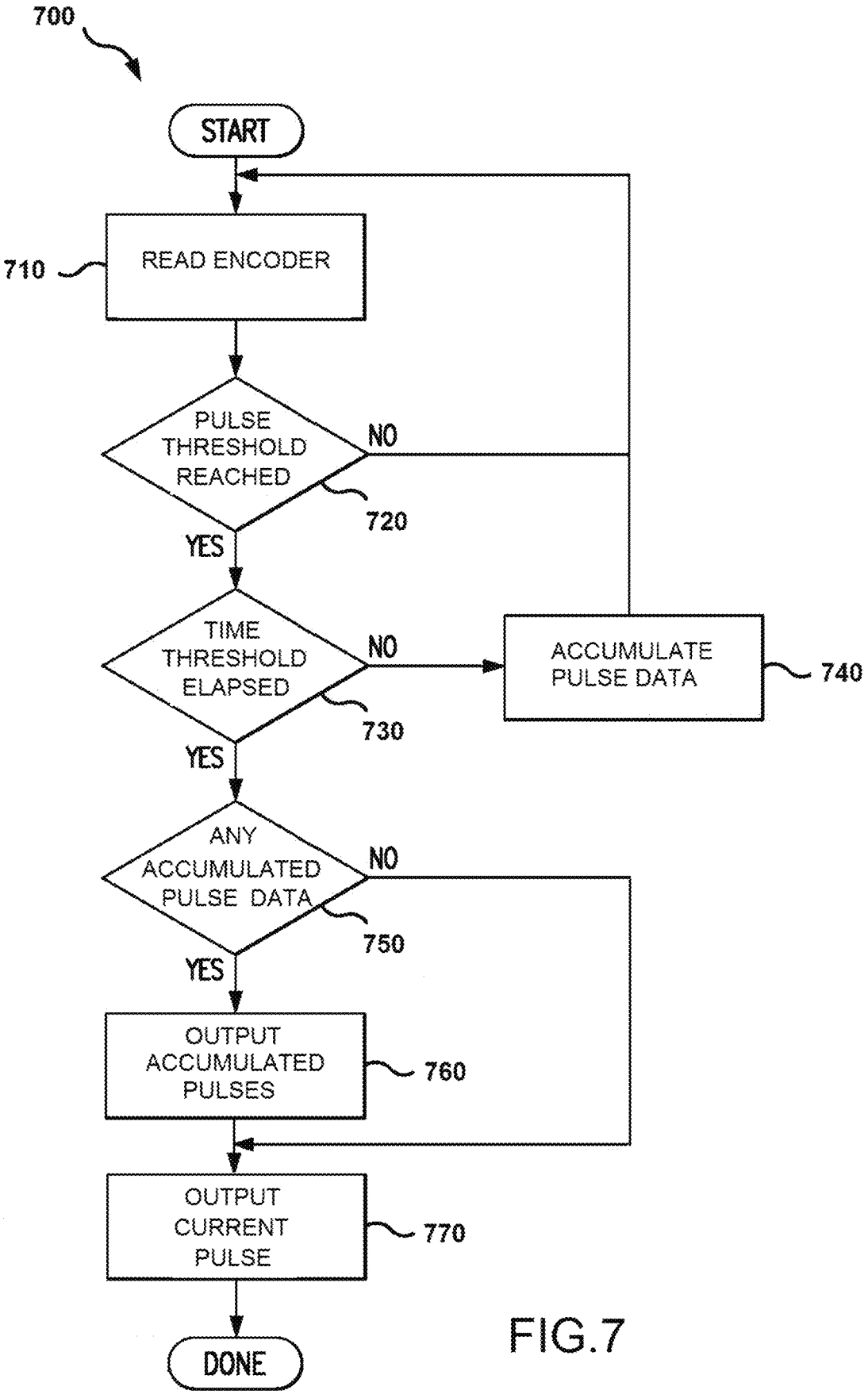
FIG. 7 is a flowchart for a method in accord with at least some aspects of the disclosed concepts.

FIG. 7 represents one method 700 to perform the above-described functions associated with the reflection of a motion of the rotatable mechanical bezel on a video display in accordance with one or more embodiments such as the physical assembly shown in FIG. 5 and the software architecture illustrated by FIG. 6. In step 710, the microcontroller 530 of FIG. 5 or CPU 42 or by any other processor associated with a video display assembly of this type reads the encoding unit for pulses and interprets the pulses to create clockwise or counterclockwise direction information. In step 720, it is determined whether a threshold number of pulses, for example, ten, in the same direction have been received. If the threshold number of pulses has not been received, a threshold counter is incremented at the encoder is read again at step 710. Otherwise, if the threshold has been reached, it is determined at step 730 whether a pulse has recently been sent to the video display processor. If so, the current pulse is held and the encoder is read again at step 710. If, however, if the time since the last output pulse has exceeded a predetermined threshold, for example, 16.67 milliseconds, a check is made to see if any pulses have been accumulated at step 750. If there are accumulated pulses, these pulses are output to the video display processor at step 760. Whether there are accumulated pulses or not, the current pulse is output to the video display processor at step 770.

In accordance with one or more embodiments, the rotatable mechanical bezel may be coupled to a motor which may be used to drive and/or stop the bezel and its associated display image at a desired location, for example, to control the result of a spinning video wheel. The servo motor may also brake and simulate heaviness/weight by enacting a "dynamic friction component" which is actually the micro controller being able to actuate the motor to apply various levels of motion/force in an opposite direction to a given current wheel motion direction and proportional to a given current wheel motion. This will be perceived, by the user, as the bezel being more difficult to turn. The motor may also be used to provide resistance so that the player-manipulated ring (FIG. 4, 420) may be made of a relatively lightweight and inexpensive material, such as chromed plastic, while having the feel of a relatively heavy and expensive material, such as brass. The amount of resistance may also be controlled to provide other feedback to the player. For example, the more the player turns the bezel, the harder it becomes to turn. For example, the bezel may be "cocked" in one direction or the other. When the player releases the bezel, the motor may be used to drive the bezel in the opposition direction at a speed proportional to the amount the bezel was cocked. The motor may then be used to gradually slow the rotation of the bezel, and its associated image on the display, until it comes to a stop. In some embodiments, locking of the bezel may be accomplished by the microprocessor electronically signaling the motor to lock. For example, the bezel may be locked when unavailable for use as an input device. In embodiments including motors, such as servo motors, that include encoders, a separate encoder (see, for example, FIG. 4, 470) may be eliminated.

Figure 8A:
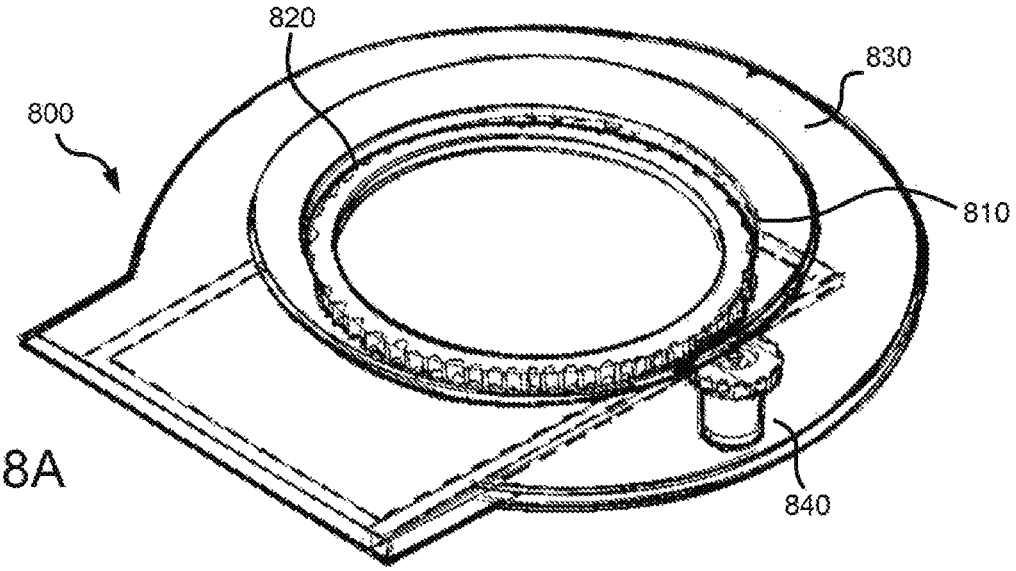
FIG. 8A is an illustration of an exemplar video display assembly in accordance with one or more embodiments.

Referring to FIG. 8A, in accordance with one or more embodiments, video display assembly 800 includes bearing race 810 and bearing assembly 820 extending beneath the outer surround 830 as opposed to above it, as described with respect to FIGS. 4A and 4B. Extended beneath the outer surround 830, the motor 840 can be hidden and make contact with the bearing race 810. In some embodiments, as shown, the coupling between motor 840 and bearing race 810 may include teeth on each which engage to prevent slippage.

Figure 8B:
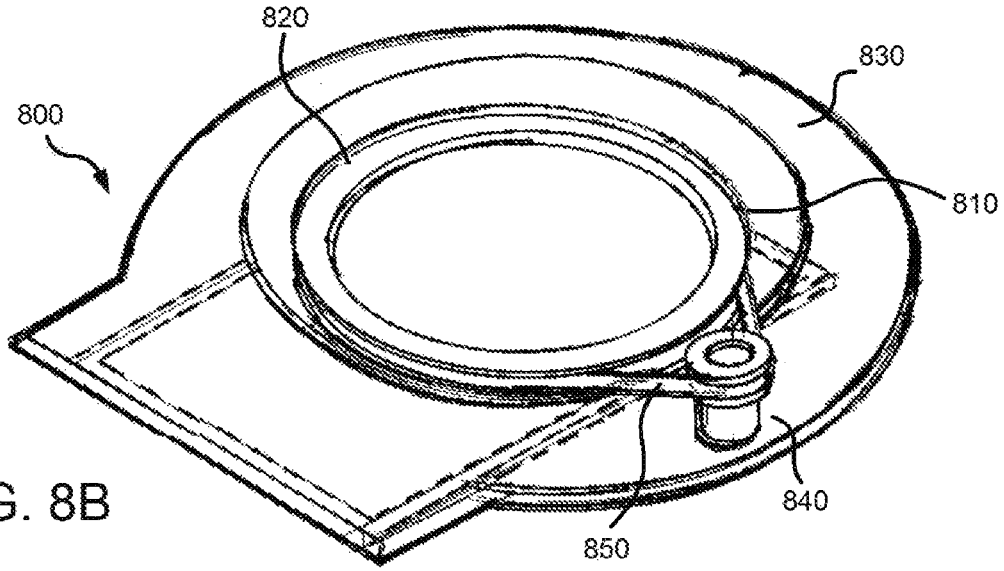
FIG. 8B is an illustration of an exemplar video display assembly in accordance with one or more embodiments.

Referring to FIG. 8B, in accordance with one or more embodiments, video display assembly 800 again includes bearing race 810 and bearing assembly 820 extending beneath the outer surround 830. Motor 840 makes contact with the bearing race 810 via a belt 850. Such a coupling provides lateral displacement for the motor.

In other embodiments, not shown, the motor 840 may be coupled to the bearing race 810 via a multiple gear system, which also may provide lateral displacement for the motor depending on the number of intervening gears. In some embodiments, a combination belt and gear system may be employed. In still other embodiments, curved linear servo motors may be utilized in place of a servo motor. In some of these embodiments, the curved linear servo motors may serve as a replacement for the bearing ring entirely, wherein the curved linear system includes a curved rail and one or more drivable blocks that ride the rail. The player-manipulated ring may be coupled directly to the block (or blocks) to provide motion, resistance, etc. Examples of suitable linear motor solutions for such embodiments may be found, for example, at https://www.motionsolutions.net/store/pc/THK-HMG-Straight-Curved-Guide-85p709.htm.

Figure 9A:
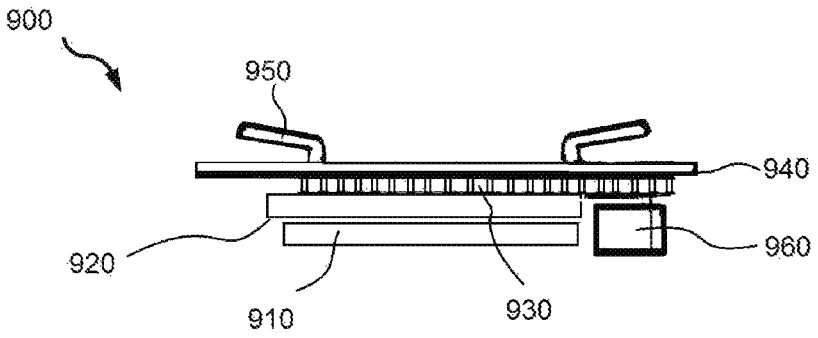
FIG. 9A is a cross-section illustration of an exemplar video display assembly in accordance with one or more embodiments.
Figure 9B:
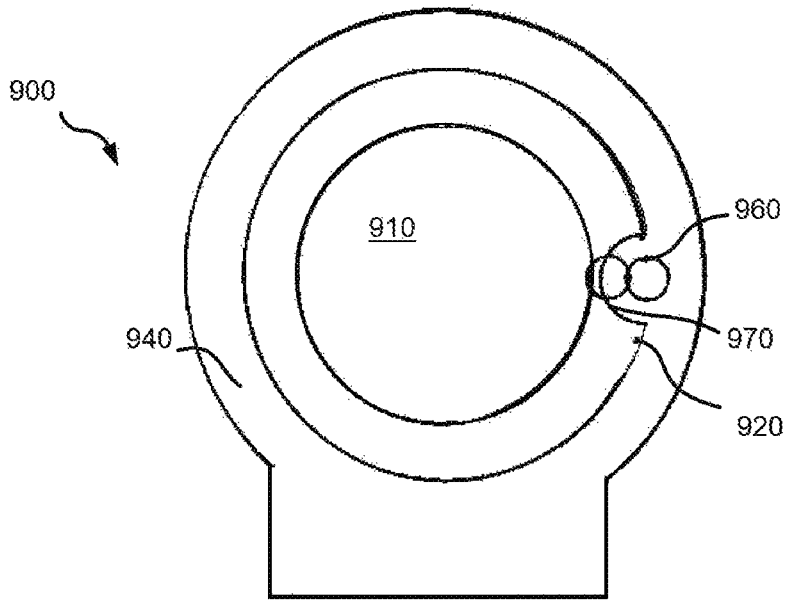
FIG. 9B is a bottom view of the exemplar video display assembly in accordance of FIG. 9A.

In some embodiments, for aesthetic or functional reasons such as the inclusion of a motor, as described above, the stack order of the components of the video assembly may vary. As an example, FIG. 9A, in accordance with one or more embodiments, illustrates in cross-section a video wheel assembly 900 in which the screen 910 may be the bottom-most component, the support plate 920 is mounted above the screen 910 and the bearing portions 930 are set above the support plate 920 but beneath the player-manipulated ring 950 and the outer surround 940. In some embodiments, when the motor 960 and the support plate 920 are at the same vertical position, the support plate 920 may have a cutout 970 to receive the motor 960, as illustrated in a bottom view of assembly 900 in FIG. 9B.

Figure 10:
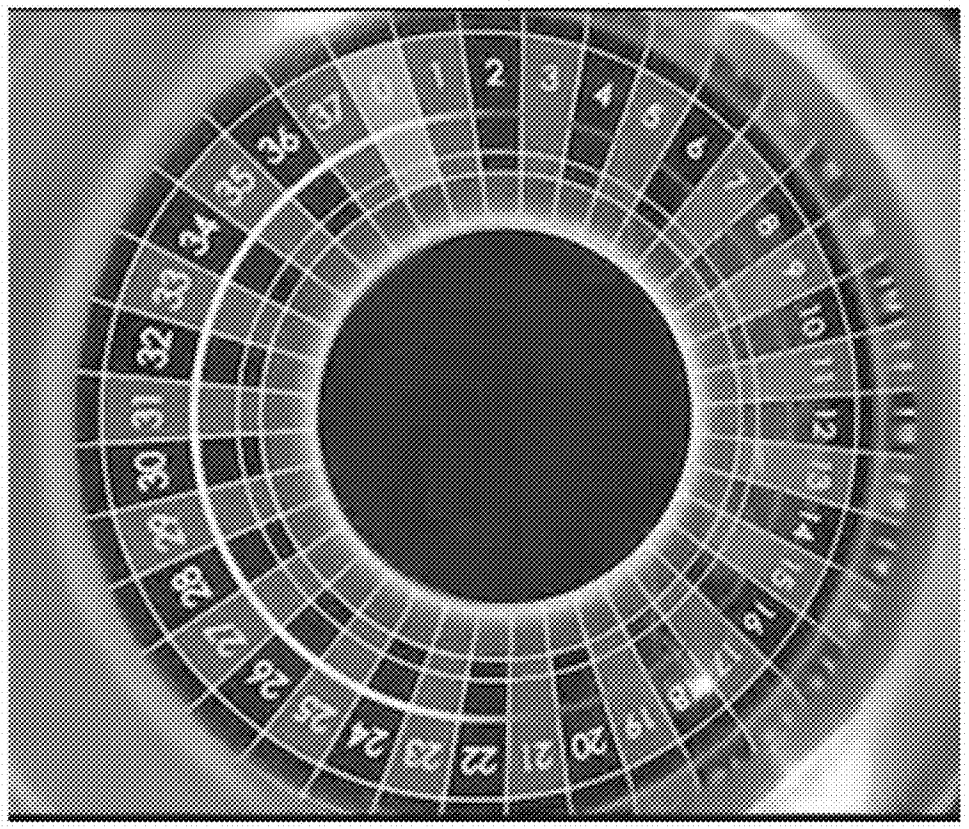
FIG. 10 is an illustration of a game presentation on the video display in accordance with one or more embodiments.

The video display of the assembly of the invention may present content related to base game play, bonus game play, machine configuration and diagnostic information, player menus or game controls operated by the rotatable mechanical bezel, the touchscreen, or a combination thereof. In one example, menu selections may be presented in a list or around the periphery of the display and the bezel rotated to move a pointer or arrow from one selection to another, then selected by pressing a button or touch area. Alternately, the menu selection may be selected directly via a touchscreen. FIG. 10 illustrates a roulette wheel that may be used in base or bonus game play, though any display of game related contents such as reels, a wheel of fortune, mazes, game boards or the like may be presented. The bezel may be used as a steering wheel, a wheel spinner, a reel-spin trigger, or to provide any other input where its rotation, speed of rotation and/or direction of rotation may influence the operation of the gaming machine or the play of one or more games thereon.

Figure 11:
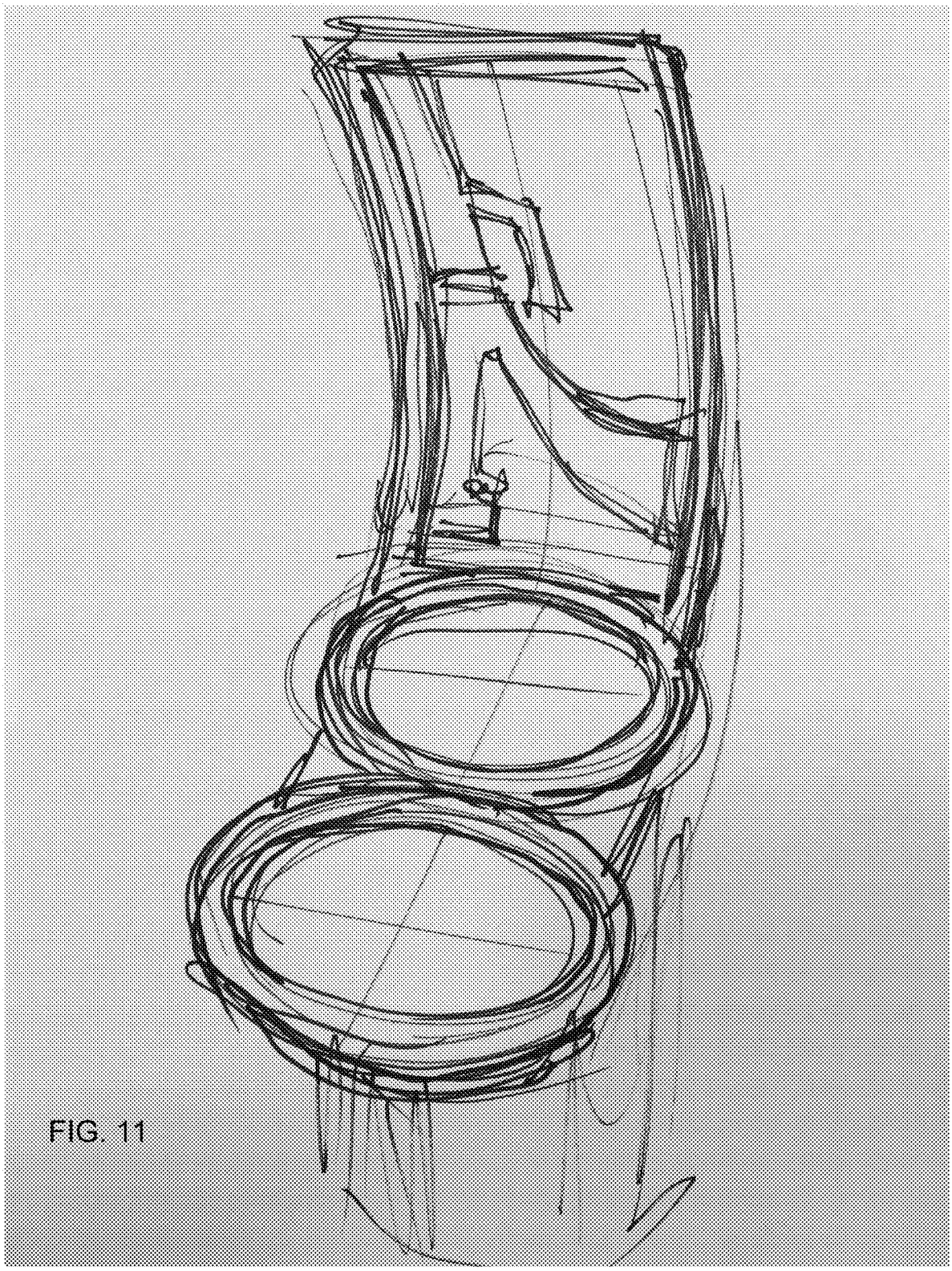
FIG. 11 is an isometric view of a free-standing gaming machine in accordance with one or more embodiments.
Figure 12:
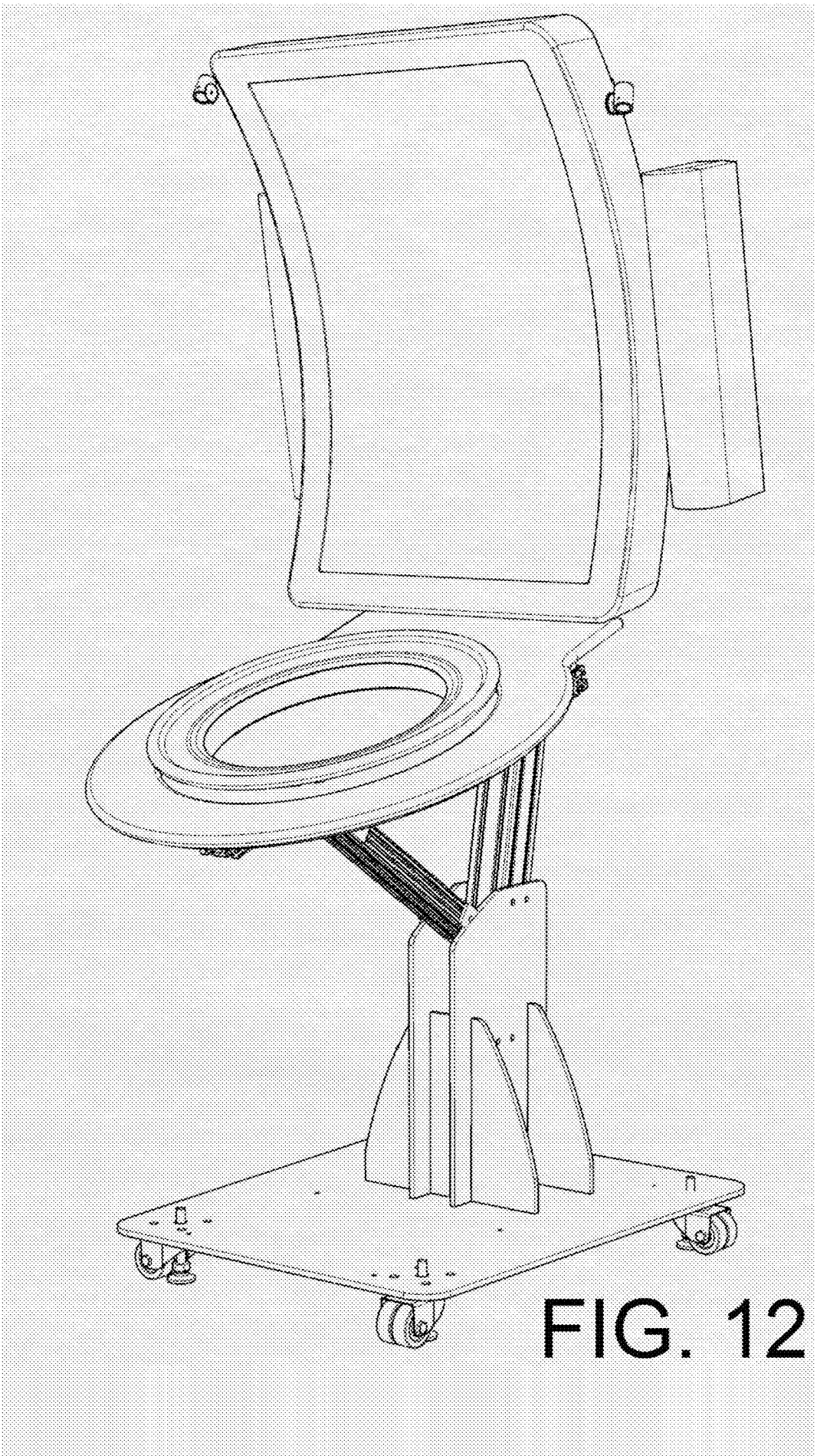
FIG. 12 is an isometric view of a free-standing gaming machine in accordance with one or more embodiments.

In accordance with other embodiments, various gaming machine cabinet designs, such as those illustrated by the sketches of FIG. 11 and FIG. 12, may include a video display device with a rotatable mechanical bezel. FIG. 13 further illustrates that a single machine may include more than one such video display assemblies.

In accordance with still other embodiments, the video display assembly of the invention may be used to retrofit or extend the functionality of a pre-existing gaming machine's cabinet in order to overly a portion or all of the primary display of the gaming machine with a mechanical rotatable bezel. For example, the order of components illustrated by FIG. 9A may be used in such an embodiment, with display 910 omitted from the assembly, instead being provided by the pre-existing gaming machine's display. Gaming machine 10 in FIG. 1 illustrates one example of a pre-existing gaming machine cabinet with such an "add-on" video display assembly providing the additional rotatable mechanical bezel components.

Figure 14:
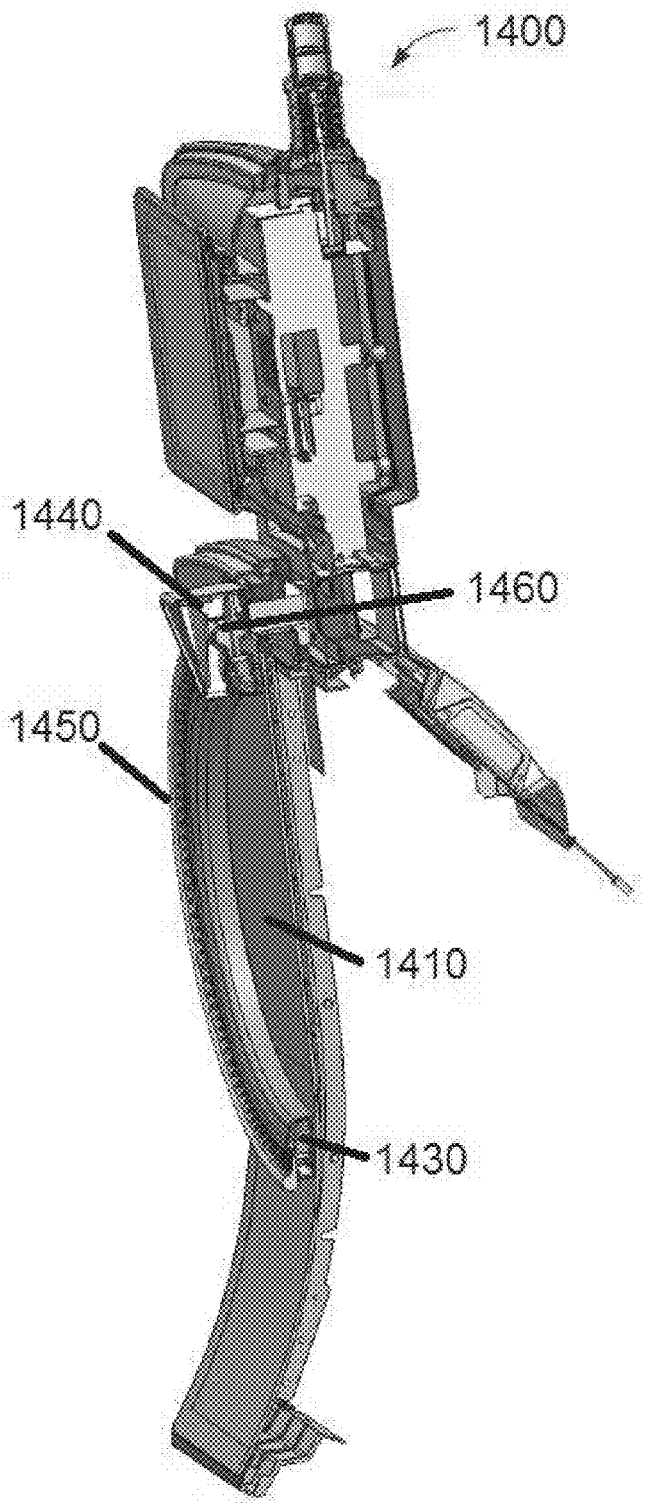
FIG. 14 is a cross-section view of a video display assembly in accordance with one or more embodiments.

FIG. 14, in accordance with one or more embodiments, illustrates a cross-section example of such an "add-on" video display assembly. All of the components of the video display assembly 1400, less screen 1410, are attached as an assembly to the cabinet of the pre-existing gaming machine with fasteners such as screws, bolts, etc. such that the remainder of the components in the stack described in FIG. 9 are mounted above screen 1410.

Screen 1410 is provided by the pre-existing gaming machine display 1410. For example, the bearing portions 1430 are beneath the player-manipulated ring 1450. Motor 1460 is concealed within a wheel pointer "arrow" sub-assembly 1440 and connected to the rotatable bezel's player-manipulated ring 1450 by a gear mounted to shaft of motor 1460 interfacing with teeth on the inner portion of the player-manipulated ring 1450. In the example of FIG. 14, the video display assembly 1400, including the gear assembly, motor 1460 and its motor controller, lighting and an associated lighting controller and "arrow" assembly 1440, operates as a mountable sleeve. The sleeve slides over the top portion of the existing cabinet housing including screen 1410 and is locked in placed via set screws on the back. In this embodiment, the top cap of the pre-existing screen is replaced with a modified version that allows for a cable way for power and control cables from the video display assembly 1400 to pass into the pre-existing gaming machine's cabinet. An additional strut may be added to account for the video display assembly's added weight when opening the gaming machine cabinet's door. Additional cable routing, which may include track assemblies, may be required to support the new video display assembly 1400. Without deviating from the scope and spirit of the invention, the order of components in the stack making up video display assembly 1400 may vary; not all components in the stack may be required for any particular embodiment, or they may vary as described above.

In the example shown in FIG. 14, as well as in other embodiments, the rotatable mechanical bezel may be driven by a geared direct current motor with a low resolution encoder directly on the motor shaft. The ratio of the small shaft gear relative to the large rotatable mechanical bezel gear provided by the teeth on the inner portion of the player-manipulated ring provides the encoder with a very high resolution relative motor position with which to detect the motor's velocity and position. In addition to having the encoder included in a single package with the motor, such a DC motor may be preferable to a stepper motor for its non-detent feel. It may also allow detection of a player-initiated spin at any position and speed without concern for synchronizing the stepper phases or for stepper motor slipping steps.

The motor may be run in a closed loop mechanism known as a PID control loop, wherein relative positions of the motor provided by the encoder are used to constantly adjust the motor's velocity according to the demands of the associated game logic. This practice also allows the control loop logic to adjust to changing loads such as friction, including the player attempting to slow or stop the rotation of the video wheel. The PID control loop reads the encoder position and compares it to a previously read encoder position. A desired motor speed is then calculated using proportional, integral, and derivative responses, summing those three components to compute the output. Any slow-downs caused by outside forces on the rotatable mechanical bezel coupled to the motor are thus accounted for by the control loop logic. The control loop logic also provides information such as positional/velocity feedback and motor driver current to the game logic, which is then also able to monitor for tilt conditions, such as the player trying to stop the wheel. For example, if the player tries to slow down the wheel, current in the motor spikes and lags in expected position and velocity become significantly large.

In one or more embodiments, the control loop logic controlling the motor may be in one of several exemplary states illustrated by Table 4.

TABLE 4

| |
|---|
| Idle: Nothing is happening. |
| Freewheel: Configures motor for free wheel. Must not be moving when entering this state. |
| Waiting for velocity trigger: In free wheel, waiting for user spin speed to exceed trigger threshold. |
| Ramping up: Spin was engaged by button, linearly ramps up velocity of wheel until reaches trigger velocity. |
| Waiting for release: After velocity trigger, waits until a decrease in speed is detected. |
| Wait while speeding: If wheel released and is over max speed, waits until slows down to max speed. |
| Moving: Motor velocity is driven by spin curve. |

TABLE 4-continued

| |
|---|
| Brake: Starts braking wheel. |
| Lock Wheel: Wheel actively resists rotation. Used when racking win. |
| Tilted: Waiting for spin to finish after a tilt. |

Figure 15:
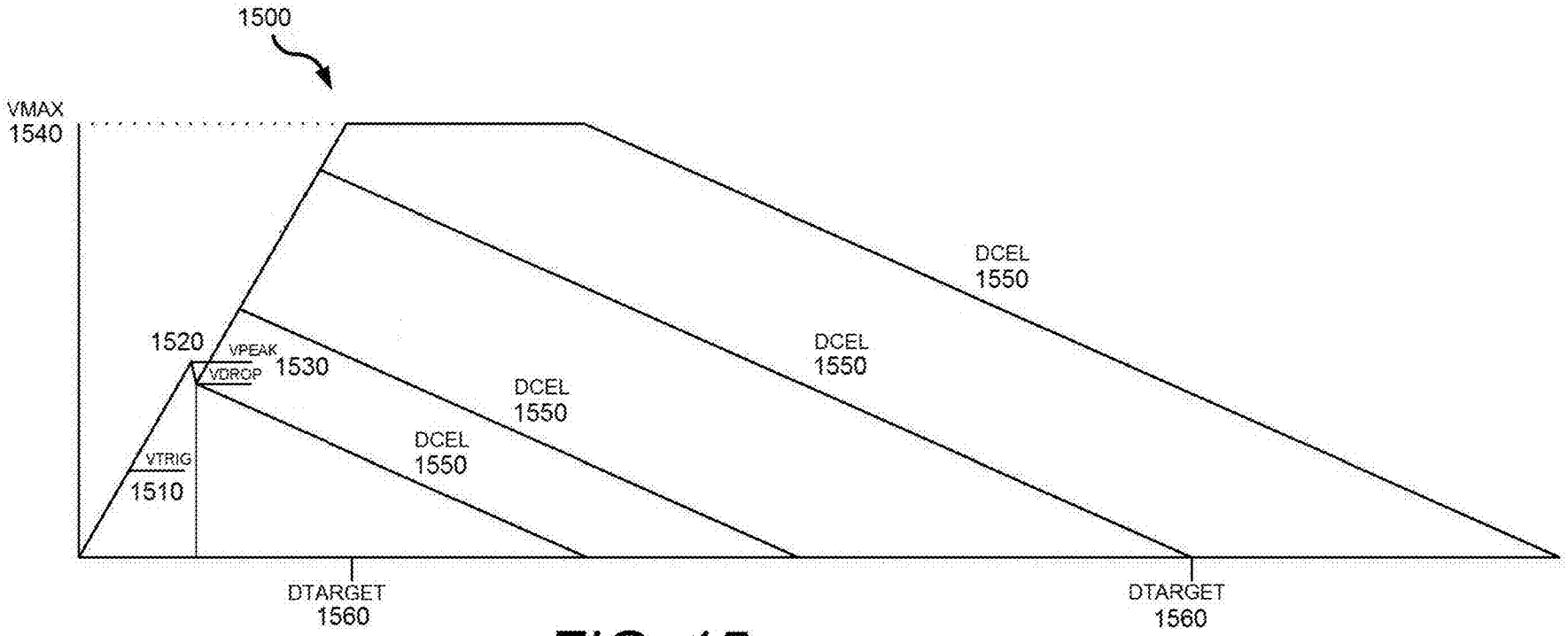
FIG. 15 is a state transition diagram in accordance with at least some aspects of the disclosed concepts.

FIG. 15, in accordance with one or more embodiments, provides a state transition diagram 1500 illustrating possible transitions between the control loop states of Table 4. From an "idle" state, in which the wheel is not intended for use, the wheel is enabled and the control loop logic enters a "freewheel" state, during which the player must spin the rotatable mechanical bezel. Based on the encoder-derived velocity of the rotatable mechanical bezel, motion of the rotatable mechanical bezel is detected and the logic enters a "waiting for velocity trigger" state, where it remains until the velocity reaches at least a certain trigger velocity, VTRIG 1510.

Once a velocity of at least VTRIG 1510 has been achieved, the logic enters a "waiting for release" state. When the velocity drops by a defined VDROP 1520 from a peak detected velocity VPEAK 1530, the rotatable mechanical bezel is deemed released and the logic enters a "moving" state, wherein the motor driven mechanism is engaged to gradually carry the synchronized video wheel in a "braking state" to a desired resting position by following a linear deceleration path DCEL 1550 from the point of release to a final stop at the desired target DTARGET 1560, at which point a "lock wheel" state is entered.

If, in the "waiting for release state," while waiting for the velocity to drop by VDROP 1520, the rotatable mechanical bezel instead achieves the maximum possible velocity, VMAX 14540, the logic enters a "waiting while speeding" state until the rotatable mechanical bezel slows to VMAX 1540 or below, where the control loop logic then progressively enters the "moving," "braking" and "lock wheel" states as above.

In some embodiments, in lieu of the player spinning the wheel by engaging the rotatable mechanical bezel, a "spin" button may instead be pressed. In this case, the logic enters a "ramping up" state, wherein the motor is used to drive the rotatable mechanical bezel to VTRIG 1510, after which the logic then progressively enters the "moving," "braking" and "lock wheel" states as above.

Similarly, if the player attempts to interact with the rotatable mechanical bezel once the logic has entered the "moving" state, the control loop logic (or associated game logic) registers a "tilt" and the rotatable mechanical bezel is effectively disengaged from the video wheel in that the motor provides no resistance to the player and inputs from the rotatable mechanical bezel are ignored. The video wheel continues to follow the deceleration path DCEL 1550 to the desired target DTARGET 1560, where the "lock wheel" state is then entered.

In one or more embodiments, the deceleration path DCEL 1550 may be a nonlinear deceleration path. For example, the wheel may first quickly decelerate and then the slope of the deceleration may change so that the final few stops come in very slowly to build anticipation of the final result.

Once the activity involving the wheel is concluded, for example, when a game cycle or bonus game involving the wheel is completed, the control loop logic enters the "idle" state until the wheel is once again activated.

As described above, the player may use the rotatable mechanical bezel to initiate a spin of the underlying video wheel in either direction. Once the rotatable mechanical bezel reaches a qualifying velocity, the motor engages to continue the spin and to then decelerate to place a predetermined location/wedge adjacent to the pointer. At any time during the spin, if the rotatable bezel is impeded or stopped by the player, the motor may be effectively disengaged such that the video wheel decouples and continues to spin until it stops in the predetermined location. However, in some embodiments, provided the rotatable mechanical bezel is not slowed or stopped by the player, the player may provide one or more additional rotational inputs to increase the current speed of the wheel spin without decoupling the video wheel from the rotatable mechanical bezel. For example, as the wheel slows, the player may anticipate an undesired outcome and try to prolong the spin. In some embodiments, to provide additional entertainment value, the game may encourage the player to prolong the spin by providing a suggestion through text or audio messaging, for example, "You may wish to spin longer!" If the player provides additional rotational input in the direction of wheel travel, in effect, the control loop logic is returned to the "waiting for release state." Once the player releases the rotatable mechanical bezel and its velocity drops, as described above, the control loop logic returns to the "moving" state and proceeds as described above. In most embodiments, prolonging the wheel spin will have no actual effect on the originally intended DTARGET 1560.

Figure 16:
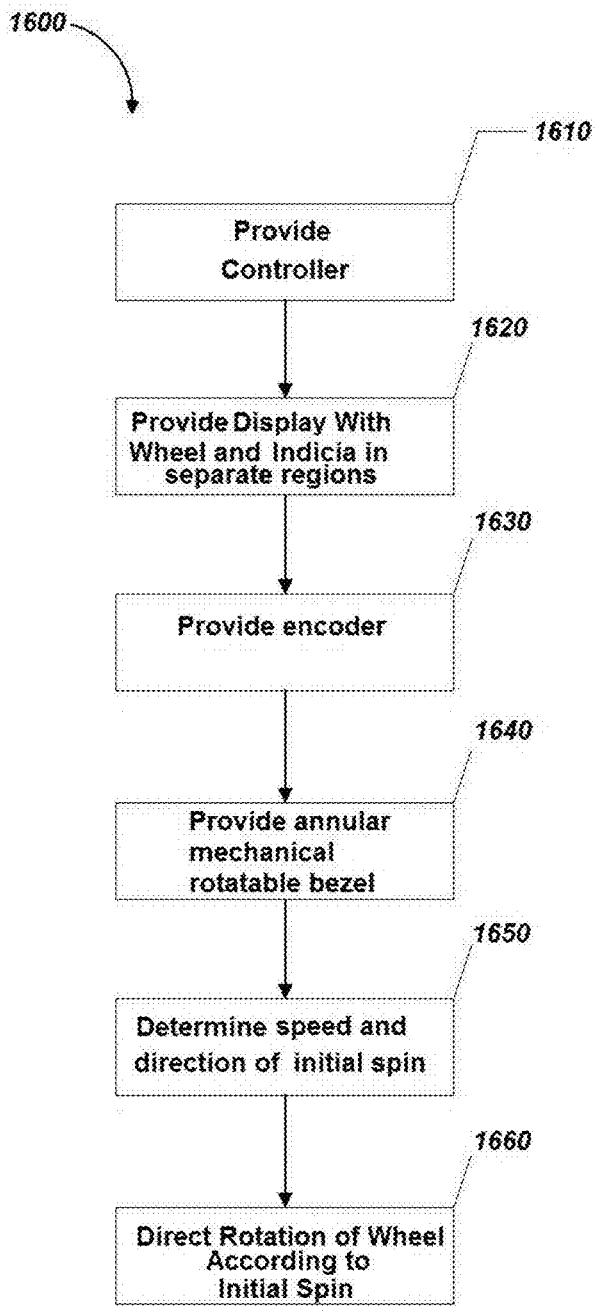
FIG. 16 is a flowchart for a method in accord with at least some aspects of the disclosed concepts.

FIG. 16 represents an example of a method 1600 to perform the above-described functions associated with the reflection of a motion of the rotatable mechanical bezel on a video display in accordance with one or more embodiments. In step 1610, a controller for executing the control loop logic described above is provided. In step 1620, a single video display visually separated by physical aspects of the video display assembly into two regions, one for the display of a segmented wheel, the other for display of other game indicia, is provided. The video display of FIG. 1 provides an example of such a video display, wherein primary screen 18 is divided into two regions, the first region 36 for presentation of the wheel, and the second region 38 for display of the other game indicia. In step 1630, an encoder, for example, an encoder attached to the shaft of a direct current motor is provided. In step 1640, an annular mechanical rotatable bezel coupled to the motor and encoder, for example, by one or more gears, is provided. In operation, interpretation of encoder data resulting from an external manually provided input determines the speed and direction of an initial spin of the wheel, which is the portrayed as rotation of the wheel according to the speed and direction at step 1660.

While various embodiments have been described above, it should be understood that they have been presented by way of example only, and not limitation. Thus, the breadth and scope of a disclosed embodiment should not be limited by any of the above-described exemplary embodiments, but should be defined only in accordance with the following claims and their equivalents.

What is claimed is:

1. A video display assembly for a gaming machine comprising:

a controller;

a video display coupled to the controller, the video display comprising a first region and a second region, the first region depicting a segmented rotatable wheel, the second region visually separated by one or more physical aspects of the video display assembly and depicting one or more game play indicia;

an encoder coupled to the controller;

a mechanical annular rotatable bezel coupled to the encoder and overlaying the video display such that the bezel encompasses at least a portion of the first region, the portion being visible within the periphery of the bezel;

the controller executing logic to determine speed and direction of the bezel in response to signals generated by the encoder according to an initial manual player input to the bezel and to direct rotation of the segmented rotatable wheel on the video display in accordance with the determined speed and direction.

2. The video display assembly of claim 1 further comprising a motor operatively coupled to the rotatable bezel.

3. The video display assembly of claim 2 wherein the motor comprises a direct current motor.

4. The video display assembly of claim 2 wherein the motor is coupled to the bezel via one or more gears.

5. The video display assembly of claim 2 wherein, upon the controller detecting an end of the initial manual player input, the motor provides mechanical assistance to prolong the spin of the bezel and of the wheel for a time period associated with the magnitude of the initial manual player input.

6. The video display assembly of claim 5 wherein the controller adjusts the speed of the motor to match the rotational speed of the bezel to the rotational speed of the segmented rotatable wheel.

7. The video display assembly of claim 5 wherein the controller detects a tilt condition if the rotation of the bezel is externally slowed subsequent to the end of the initial manual player input.

8. The video display assembly of claim 2 wherein the motor provides resistance to the rotation of the rotatable bezel.

9. The video display assembly of claim 8 wherein the resistance to the rotation of the bezel comprises matching the rotational speeds of the bezel and the segmented rotatable wheel according to a predetermined deceleration profile until the segmented rotatable wheel slows to a stop at a predetermined location.

10. The video display assembly of claim 2 wherein the motor can be locked to prevent rotation of the bezel.

11. The video display assembly of claim 10 wherein the other game play indicia are associated with a base game, and wherein the controller is configured to unlock the motor to enable the bezel to be rotated in response to a triggering condition in the base game.

12. A video display assembly for a gaming machine comprising:

a video display comprising a first region and a second region, the first region depicting a segmented rotatable wheel, the second region depicting one or more game play indicia; and a mechanical annular rotatable bezel rotatable relative to, and overlaying, the video display such that the bezel encompasses at least a portion of the first region, the portion being visible within the periphery of the bezel.

13. The video display assembly of claim 12 wherein the other game play indicia are associated with a base game, and wherein the controller is configured to unlock a motor to enable the bezel to be rotated in response to a triggering condition in the base game.

14. The video display assembly of claim 12 wherein the first region is flat and the second region is concave relative to the player.

15. The video display assembly of claim 12 wherein the video display is a pre-existing component of the gaming machine and the mechanical annular rotatable bezel is subsequently mounted to the pre-existing gaming machine.

16. A method of providing a video display assembly for a gaming machine comprising:

providing a controller;

providing a video display coupled to the controller, the video display comprising a first region and a second region, the first region depicting a segmented rotatable wheel, the second region visually separated by one or more physical aspects of the video display assembly and depicting one or more game play indicia;

providing an encoder coupled to the controller;

providing a mechanical annular rotatable bezel coupled to the encoder and overlaying the video display such that the bezel encompasses at least a portion of the first region, the portion being visible within the periphery of the bezel;

determining, via the controller, speed and direction of the bezel in response to signals generated by the encoder according to an initial manual player input to the bezel; and directing rotation of the segmented rotatable wheel on the video display in accordance with the determined speed and direction.

17. The method of claim 16 further comprising providing a motor operatively coupled to the rotatable bezel.

18. The method of claim 17 wherein the motor comprises a direct current motor.

19. The method of claim 16 further comprising coupling the motor to the bezel via one or more gears.

20. The method of claim 16 further comprising, upon detecting, via the controller, an end of the initial manual player input, providing mechanical assistance via the motor to prolong the spin of the bezel and of the wheel for a time period associated with the magnitude of the initial manual player input.

21. The method of claim 20 further comprising adjusting the speed of the motor via the controller to match the rotational speed of the bezel to the rotational speed of the segmented rotatable wheel.

22. The method of claim 20 further comprising detecting a tilt condition via the controller if the rotation of the bezel is externally slowed subsequent to the end of the initial manual player input.

23. The method of claim 16 further comprising providing, via the motor, resistance to the rotation of the rotatable bezel.

24. The method of claim 23 further comprising matching the rotational speeds of the bezel and the segmented rotatable wheel according to a predetermined deceleration profile until the segmented rotatable wheel slows to a stop at a predetermined location.

25. The method of claim 16 further comprising locking the motor to prevent rotation of the bezel.

* * * * *